US007452177B2

(12) United States Patent
Gokita

(10) Patent No.: US 7,452,177 B2
(45) Date of Patent: Nov. 18, 2008

(54) WORKING MECHANISM FOR CONSTRUCTION MACHINE

(75) Inventor: Osamu Gokita, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 216 days.

(21) Appl. No.: 10/590,773

(22) PCT Filed: Sep. 14, 2005

(86) PCT No.: PCT/JP2005/017322

§ 371 (c)(1),
(2), (4) Date: Aug. 25, 2006

(87) PCT Pub. No.: WO2006/035639

PCT Pub. Date: Apr. 6, 2006

(65) Prior Publication Data

US 2007/0172343 A1 Jul. 26, 2007

(30) Foreign Application Priority Data

Sep. 29, 2004 (JP) ..... 2004-284931

(51) Int. Cl.
*E02F 3/38* (2006.01)

(52) U.S. Cl. ..... 414/694; 414/685; 414/722

(58) Field of Classification Search ..... 414/680, 414/685, 722, 729, 694; 294/68.23; 37/406, 37/411

See application file for complete search history.

(56) References Cited

U.S. PATENT DOCUMENTS 5,525,028 A * 6/1996 Ogasawara et al. ..... 414/694
5,924,325 A * 7/1999 Brucher et al. ..... 74/106

FOREIGN PATENT DOCUMENTS

| | | |
|---|---|---|
| JP | 6-659940 | 3/1994 |
| JP | 9-60030 | 3/1997 |
| JP | 9-60030 | 9/1997 |
| JP | 11-181822 | 7/1999 |
| JP | 11-247238 | 9/1999 |
| JP | 2001-317076 | 11/2001 |
| JP | 2003-96810 | 4/2003 |

* cited by examiner

*Primary Examiner*—Donald Underwood
(74) *Attorney, Agent, or Firm*—Mattingly, Stanger, Malur & Brundidge, P.C.

(57) ABSTRACT

A parallel support member is constituted by a pair of links that are respectively arranged on the left and right sides of a second boom. These links are connected between a first boom and a third boom. Thus, the second boom is moved to the left or right side by an offset cylinder. In this case, when one of the links pulls the third boom, the third boom, an arm, and a bucket can be moved toward the left or right side of a vehicle body to be parallel to the first boom. At this time, the links accept a force exerted in the pulling direction, but need not receive a force exerted in the compression direction, so that the cross sectional areas, the weights of these links can be reduced.

9 Claims, 18 Drawing Sheets

WORKING MECHANISM FOR CONSTRUCTION MACHINE

TECHNICAL FIELD

This invention relates to a working mechanism for a construction machine that is appropriate, for example, for an offset boom type hydraulic excavator.

BACKGROUND ART

Generally, there is an example common working mechanism for construction machines, part of which is moved (offset), in parallel, to the left or right side of the vehicle body. Such a working mechanism is employed for offset boom type hydraulic excavators, etc. (e.g., Japanese Patent Laid-Open No. 2003-96810 and No. 2001-317076).

According to these prior arts, this type of working mechanism for a hydraulic excavator is constituted by three booms, i.e., first, second and third booms, and the first boom is mounted on the vehicle body of the hydraulic excavator as to be rotatable to the upper and lower sides. Further, the second boom is mounted on the distal end of the first boom as to be swingable to the left and right sides, and the third boom is mounted on the distal end of the second boom as to be swingable to the left and right sides. Furthermore, an arm is provided at the distal end of the third boom, and a working tool, such as a bucket, is attached at the distal end of the arm.

The working mechanism also includes a boom cylinder which moves the first boom to the upper and lower sides, an offset cylinder which swings the second boom to the left and right sides, and an arm cylinder and a bucket cylinder which rotate an arm and a bucket.

According to the prior arts, single link in the shape of an elongated rod is provided, for example, on the left side of the second boom to connect the first and the third booms, and the link and the second boom constitute a parallel linking mechanism.

When the second boom is moved to the left side, the third boom located at the distal end of the second boom is pushed to the right side by the link. Then, the third boom, the arm, and the bucket are moved (offset) to the left side of the vehicle body, while their postures parallel to the first boom are maintained. Further, according to the arrangement, when the second boom is moved to the right side, the third boom is pulled to the left link, and the third boom, the arm, and the bucket are moved horizontally to the right side of the vehicle body.

According to the above described prior arts, when the second boom is moved to the left or right side, the third boom is pushed or pulled by one link. Therefore, in accordance with the direction in which the second boom is moved, a great force in the compression direction or in the pulling direction is exerted on the link. Further, when an external force to the left or right side is exerted on the third boom, the arm, and the bucket, the force in the compression direction or the force in the pulling direction is exerted on the link via the third boom.

Therefore, according to the prior arts, one link must have sufficient strength relative to the forces that are exerted in two directions, in the compression direction and in the pulling direction (especially, the force exerted in the compression direction). Therefore, for example, a large cross-sectional area (the outer diameter) and a large weight for the link are required, and accordingly, there is a problem that the size of the entire working mechanism is increased.

In addition, when the outer diameter of the link is increased, the gap between the second boom and the link is narrowed. Thus, when the third boom is moved to the left or right side within a range wherein the second boom and the link do not interfere with each other, there is a problem that the traveling distance (an offset value) is limited.

Further, when a large gap is to be provided between the second boom and the link, the forces exerted on the link in the compression direction and in the pulling direction can be reduced, however, the size of the working mechanism is increased to the left and right sides in accordance with the distance between the link and the second boom.

DISCLOSURE OF THE INVENTION

In view of the above-discussed problems with the prior art, one object of the present invention is to provide a working mechanism for a construction machine, for which the size and the weight of a link is reduced while a satisfactory strength is obtained for the link, and for which downsizing and weight reduction are promoted, without limiting the left or right distance traveled by a third boom.

To achieve the above described objective, the present invention is applied for a working mechanism for a construction machine having a first boom mounted on a vehicle body of a construction machine as to be rotatable to the upper and lower sides; a second boom mounted on a distal end of the first boom as to be swingable to the left and right sides; a third boom mounted on a distal end of the second boom as to be swingable to the left and right sides; and an arm mounted on the third boom as to be rotatable to the upper and lower sides and a working tool is mounted on the distal end thereof.

(1) The feature of the arrangement adopted by the present invention is that:

a parallel support member formed by a pair of links, which are connected between the first boom and the third boom and which are respectively arranged at the left and right positions, is provided on the second boom, and the third boom is so supported by the parallel support member as to be parallel to the first boom.

According to this arrangement, when the second boom is moved to the right side, the left link which is the constituent of the parallel support member can pull and move the third boom to the left side, and the force exerted in the pulling direction can be accepted between the first boom and the third boom. At this time, when a force is exerted in the compression direction, the right link need not accept this force. Further, when the second boom is moved to the left side, the right link pulls and moves the third boom to the right side, and can accept the force exerted in the pulling direction. At this time, when a force is exerted in the compression direction, the left link need not accept this force.

Moreover, when the arm and the working tool are to be moved either to the left or right side of the vehicle body, these parts can be maintained parallel to the first boom, so that various operations can be smoothly performed on the side of the vehicle body. In this case, when the second boom is moved either to the left or right side, the link opposite the link that accepts the force exerted in the pulling direction need not receive the force exerted in the compression direction. As a result, the links can be employed by small parts, so that the outer diameters, the cross sectional areas, and the weights are minimized so as to receive the force exerted in the pulling direction.

Therefore, the size and weight of the entire working mechanism including the links and brackets to which the links are mounted can be reduced, and the operating efficiency of the construction machine can be improved. Furthermore, since the outer diameter of the links can be reduced, even with a small working mechanism a satisfactory gap can be obtained between the second boom and the left and right links. And, the third boom can travel within a wide horizontal range without the second boom interfering with the links. Therefore, the traveling distances in the left and right directions by the arm and the working tool can be extended, and the function of the working mechanism can be increased. Furthermore, since the links are formed with a small outer diameter, the field of vision of an operator can be extended, and the operability for a small work site can be improved.

(2) Further, according to the arrangement of the invention, each of the links that constitute the parallel support member may be composed that a base end is rotatably connected to the first boom by use of one joint pin and a distal end is rotatably connected to the third boom by use of another joint pin, and a pin hole that the one joint pin is inserted is formed in the base end of the link, while a pin hole that the another joint pin is inserted is formed in the distal end of the link, and one of the two pin holes is formed as a pin movable hole that the joint pin is inserted movably in the longitudinal direction of the link.

According to this arrangement, when the second boom is moved to the left or right side, and when the force in the pulling direction is exerted on one of the left or the right links, the joint pin can be fitted into the pin movable hole of the pertinent link. As a result, the force in the pulling direction can be precisely received by use of one link, and the third boom can be moved smoothly. At this time, when the force in the compression force is exerted on the other link, the joint pin can still be longitudinally moved inside of the pin movable hole of the link. Therefore, since the other link does not receive the force in the pulling, bending, and damaging of the link can be appropriately prevented.

(3) According to the arrangement of the present invention, a base end may be rotatably connected to the first boom by use of one joint pin and a distal end may be rotatably connected to the third boom by use of another joint pin, a pin hole that the joint pin is inserted may be formed in the first boom, while a pin hole that the another joint pin is inserted may be formed in the third boom, and one of the two pin holes may be formed as a pin movable hole that the joint pin is inserted movably in the longitudinal direction of the link.

According to this arrangement, when the second boom is moved to the left or right side, and the force in the pulling direction is exerted on one of the left or right links, the joint pin for the pertinent link can be fitted into the pin movable hole in the first boom (or the third boom). Thus, substantially in the same manner as above described invention, one of the links can appropriately receive the force in the pulling direction. At this time, when the force in the compression direction is exerted on the other link, the joint pin of the link can still be moved in the pin movable hole in the first boom (or the third boom) in the longitudinal direction of the link, so that this link does not receive the force in the compression direction. Thus, the bending and damaging of the link can be appropriately prevented.

(4) Moreover, according to the arrangement of the present invention, the pin movable hole may be formed as a long hole extended in the longitudinal direction of the link.

According to this arrangement, when the force in the pulling direction is exerted on one of the left and the right links, the joint pin can be fitted into the end of the long hole of the link, and the force in the pulling direction can be accepted. At this time, since the joint pin can be moved in the long hole of the other link in the longitudinal direction, the force in the compression direction is not received. Therefore, the bending and damaging of the link can be appropriately prevented. Further, since a long hole is employed, longitudinal travel of the joint pin in the long hole is permitted, and instability of the joint pin in the widthwise direction of the long hole can also be prevented.

(5) Furthermore, according to the arrangement of the present invention, the pin movable hole may be formed as a large-diameter hole having a diameter larger than the outer diameter of the joint pin.

According to this arrangement, when the force in the pulling direction is exerted on one of the left and the right links, the joint pin can be inserted into the circumferential wall of the large-diameter hole in one of the links, and the force in the pulling direction can be received. At this time, since the joint pin can be longitudinally moved in the large-diameter hole in the other link, the force in the compression direction is not received by this link. Thus, the bending and damaging of the link can be appropriately prevented. Moreover, since the large-diameter hole is employed, a hole formation can be easily performed and productivity can be improved.

(6) In addition, according to the arrangement of the present invention, the links that constitute the parallel support member may be formed by rod members. According to this arrangement, light rod members having a small diameter may be employed as the left and right links, and the size and the weight of the entire working mechanism that includes the links can be reduced.

(7) Furthermore, according to the arrangement of the present invention, the links that constitute the parallel support member may be members, located between the first boom and the third boom, that receive a force in a pulling direction and that are flexible for accepting a force in the compression direction.

According to the arrangement, the left and the right links can be formed by employing flexible members, such as chains or wire cables. These links can stably accept the force in the pulling direction while they are extended without being loosened, and when the force in the compression direction is applied, the links are deflected or loosened, so that the force in the compression direction can easily be released.

(8) Further, according to the arrangement of the present invention, flexible members that form the links may be chains or wire cables. Thus, chains or wire cables can be employed as flexible members to form the links. Therefore, by using general-purpose metal chain, metal wire cables, or the like, a reduction in the size and weight of a working mechanism can be more prompted and the cost can also be reduced.

BEST MODE FOR CARRYING OUT THE INVENTION

Figure 1:
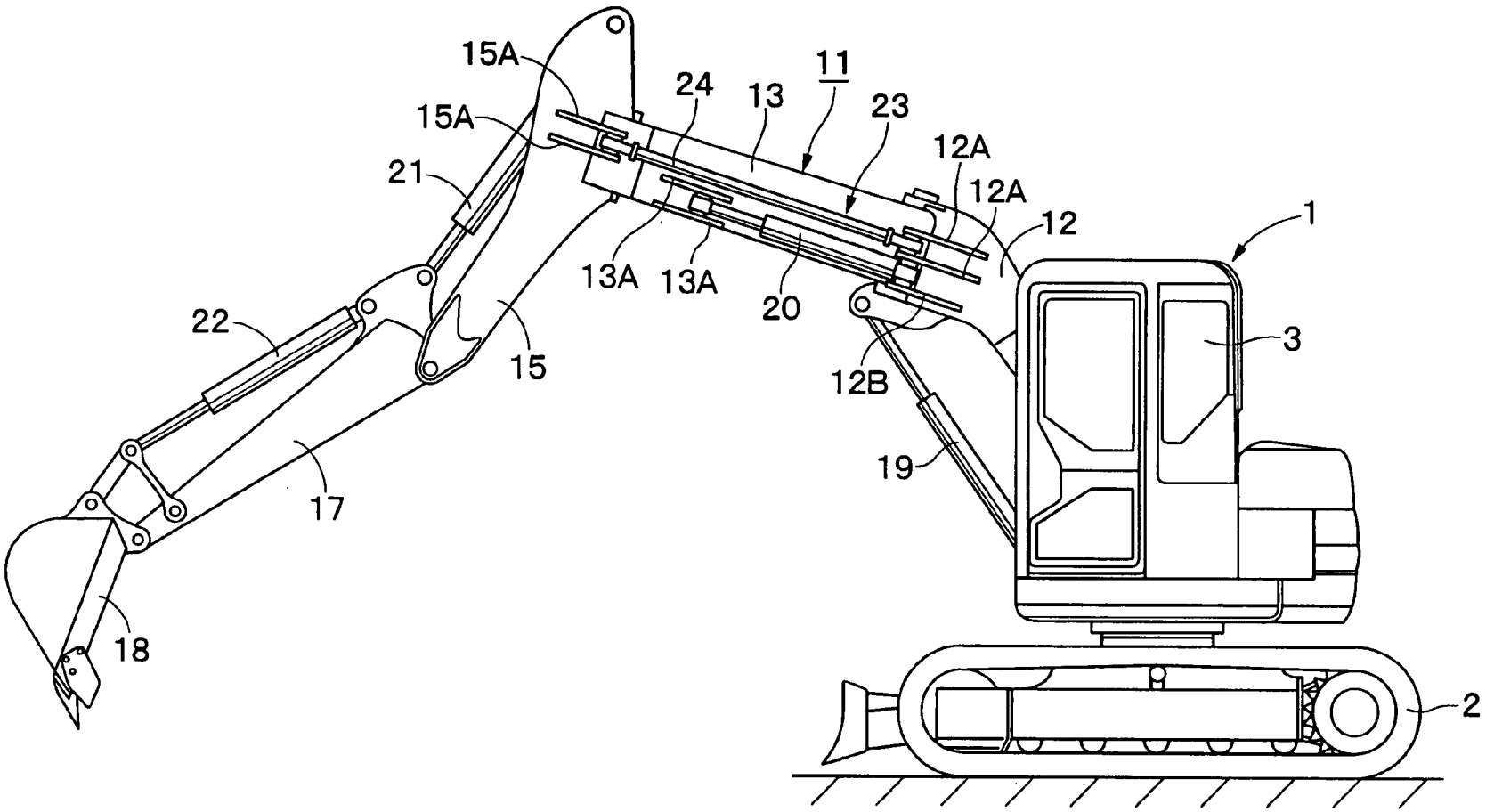
FIG. 1 is a front view of an offset boom type hydraulic excavator applied for a first embodiment of the present invention.

Hereafter, with reference to the accompanying drawings, the present invention is described more particularly by way of its preferred embodiments which are applied to a working mechanism for a construction machine.

A first embodiment is shown in FIGS. 1 through 7. For the first embodiment, an explanation will be given for a case wherein an offset boom type hydraulic excavator is employed as an example.

In the drawings, reference numeral 1 denotes an offset boom type hydraulic excavator as a construction machine applied for the first embodiment. The hydraulic excavator 1 is largely constituted by an automotive vehicular lower structure 2, an upper revolving structure 3 which is rotatably mounted on the vehicular lower structure 2 and constitutes a vehicle body together with the vehicular lower structure 2, and a working mechanism 11 which will be described after.

Figure 2:
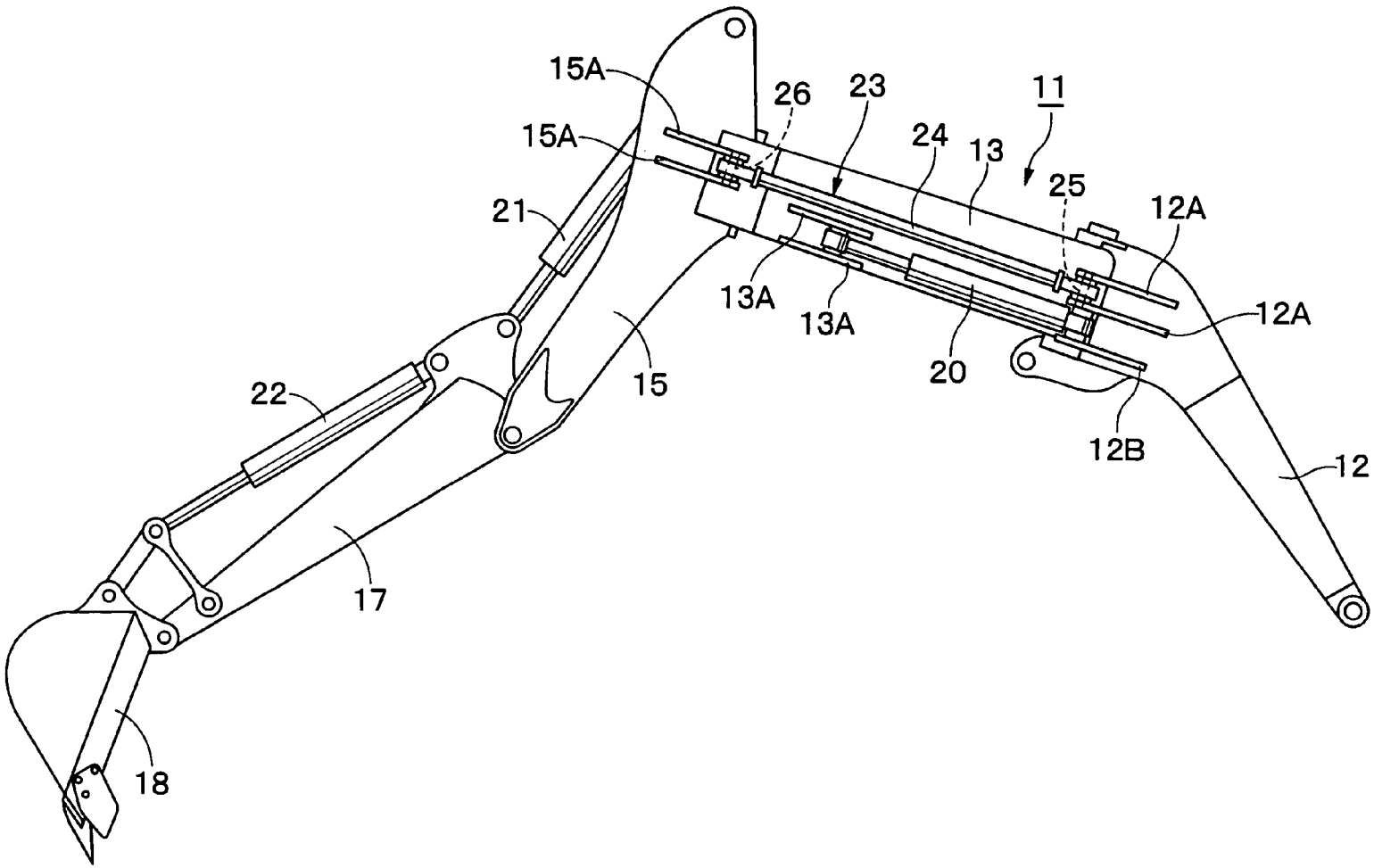
FIG. 2 is a front view of a working mechanism for the hydraulic excavator according to the first embodiment of the present invention.
Figure 3:
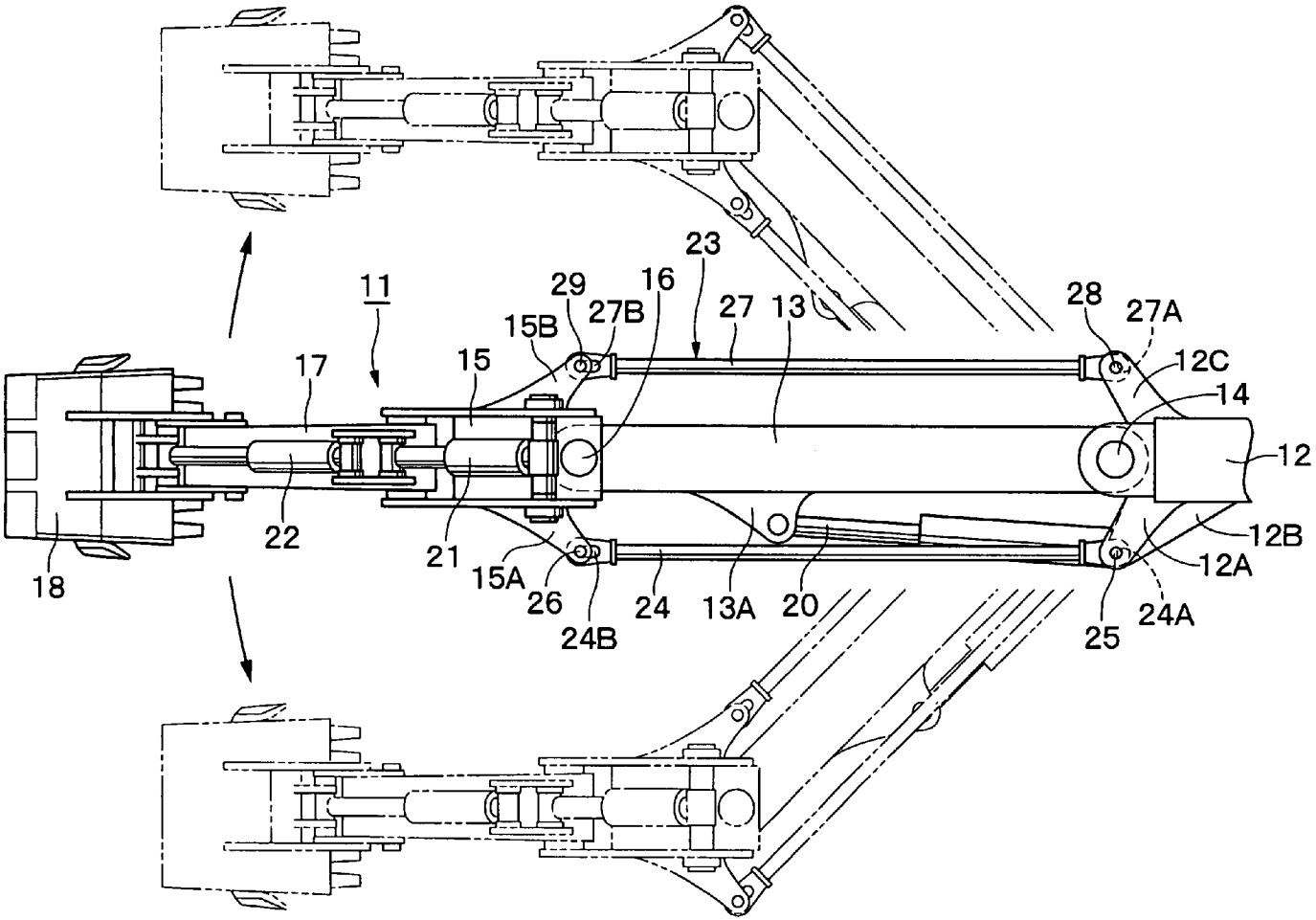
FIG. 3 is an enlarged plan view of the essential portion of the working mechanism in FIG. 2, viewed from above.

Reference numeral 11 denotes an offset boom type working mechanism that is provided on the right front of the upper revolving structure 3 for upward and downward rotational movement. As shown in FIGS. 2 and 3, the working mechanism 11 is constituted by a first boom 12, a second boom 13, a third boom 15, an arm 17, a bucket 18, cylinders 19, 20, 21 and 22 and a parallel support member 23, all of which will be described after.

Indicated at 12 is the first boom, the base of which is mounted on the upper revolving structure 3 as to be rotatable to the upper and lower sides. By welding a plural number of steel plates, the first boom 12 is formed as a hollow structure having a substantially square cross section and extending from the front to rear side of the vehicle body.

Two left brackets 12A for mounting the base end of a left link 24 that will be described after, and another bracket 12B for mounting the tube side of the offset cylinder 20 that will be described after, are projected from the left side face of the first boom 12 in vertically spaced positions. Further, two right brackets 12C (only one of them shown) for mounting the base end of a right link 27 that will be described after, are projected on the right side of the first boom 12 in vertically spaced positions. And circular pin holes (not shown) are formed in the brackets 12A and 12B.

Denoted at 13 is the second boom which is so provided at the distal end of the first boom 12 as to be swingable to the left and right sides. The second boom 13, as well as the first boom 12, is formed as an elongated hollow structure having a substantially square cross section and extending in the forward and rearward directions. The base end of the second boom 13 is connected to the distal end of the first boom 12 by employing a second boom joint pin 14, so that the second boom 13 can be moved to the left or right side, relative to the first boom 12.

As the offset cylinder 20 that will be described after is retracted or extended, the second boom 13 can swing to the left or right side at the second boom joint pin 14. In this case, two brackets 13A for attaching the rod side of the offset cylinder 20 are projected from the left side face of the second boom 13.

Indicated at 15 is the third boom which is provided at the distal end of the second boom 13 as to be swingable to the left and right sides. Substantially in the same as the first boom 12, the third boom 15 is formed as a hollow structure having a substantially square cross section by welding a plural number of steel plates and extending in the forward and rearward directions of the vehicle body. And the base end of the third boom 15 is connected to the distal end of the second boom 13 by employing a third boom joint pin 16, so that the third boom 15 can be swingable to the left or right side at the third boom joint pin 16.

Further, two left brackets 15A for attaching the distal end of the left link 24 are projected from the left side face of the third boom 15 in vertically spaced positions, while two right brackets 15B (only one of them shown) for attaching the distal end of the right link 27 are projected from the right side face of the third boom 15 in vertically spaced positions. In addition, circular pin holes (not shown) are formed in these brackets 15A and 15B.

According to the first embodiment of the working mechanism 11, the third boom 15 is formed as an elongated structure, and the arm 17 and the bucket 18 are provided at the distal end thereof. Therefore, since the total length of a boom formed by the first boom 12, the second boom 13 and the third boom 15 can be satisfactorily increased, during an excavation operation, such as the digging of deep holes, the entire boom can be rotated far downward to dig deeply into the ground.

Indicated at 17 is an arm that is so attached to the distal end of the third boom 15 as to be rotatable to the upper and lower sides. The arm 17, substantially in the same manner as the first boom 12, is provided as an elongated hollow structure that extends in the forward and rearward directions. The base end of the arm 17 is so connected to the distal end of the third boom 15 as to be rotatable to the upper and lower sides. A bucket 18 as a working tool is rotatably attached to the distal end of the arm 17.

Indicated at 19 is a boom cylinder that is located between the upper revolving structure 3 and the first boom 12 and can be extended and retracted. The boom cylinder 19, substantially in the same manner as the other cylinders 20, 21 and 22, is extended and retracted by supplying and discharging pressurized oil while employing a hydraulic oil source (not shown) provided in the vehicle body. Accordingly, the boom cylinder 19 vertically pivots the first boom 12.

Denoted at 20 is an offset cylinder that is so arranged between the first boom 12 and the second boom 13 as to be extensible and retractable. As indicated by a virtual line in FIG. 3, the offset cylinder 20 is an actuator that swings the second boom 13 to the left or right side, and that is located, for example, to the left side of the second boom 13. And the tube of the offset cylinder 20 is rotatably connected between the brackets 12A and 12B of the first boom 12, while the rod is rotatably connected between the brackets 13A of the second boom 13.

Indicated at 21 is an arm cylinder that is provided between the third boom 15 and the arm 17 so as to be extensible and retractable, and the arm cylinder 21 rotates the arm 17 to the upper and lower sides. Reference numeral 22 denotes a bucket cylinder that is provided between the arm 17 and the bucket 18 as to be extensible and retractable, and the bucket cylinder 22 rotates the bucket 18.

Denoted at 23 is a parallel support member that is attached to the second boom 13. As will be described after, the parallel support member 23 is constituted by a pair of links 24 and 27 that are located respectively on the left and right sides of the second boom 13. When the second boom 13 is moved to the left or right side, the parallel support member 23 holds the third boom 15 parallel to the first boom 12.

Figure 4:
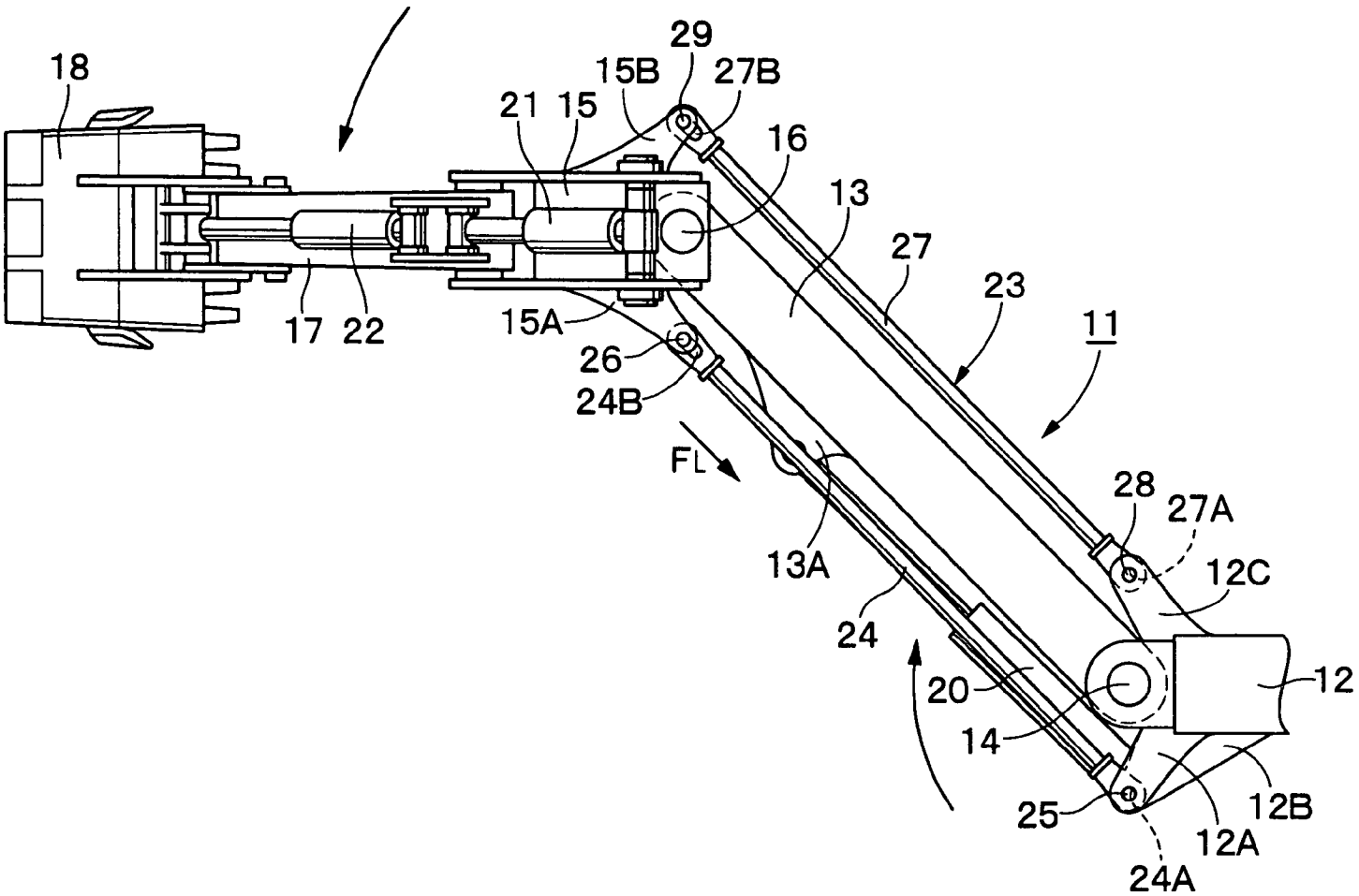
FIG. 4 is a plan view of the same in FIG. 3, showing the state wherein a third boom is offset to the right side.

Indicated at 24 is a left link arranged to the left side of the second boom 13. As shown in FIGS. 3 and 4, when the second boom 13 is moved to the right side by the offset cylinder 20, the left link 24 pulls and moves the third boom 15 to the left side. As a result, the third boom 15, the arm 17, the bucket 18, or the like are moved (offset) to the right side of the vehicle body, while maintaining a posture parallel to that of the first boom 12.

In this case, the left link 24 is formed as a rod member which is an elongated circular metal rod, and is extending substantially parallel to the second boom 13. Further, a circular pin hole 24A is formed in the base end of the left link 24, and a link joint pin 25 which is fitted between the left brackets 12A of the first boom 12 is rotatably inserted into the pin hole 24A.

Figure 6:
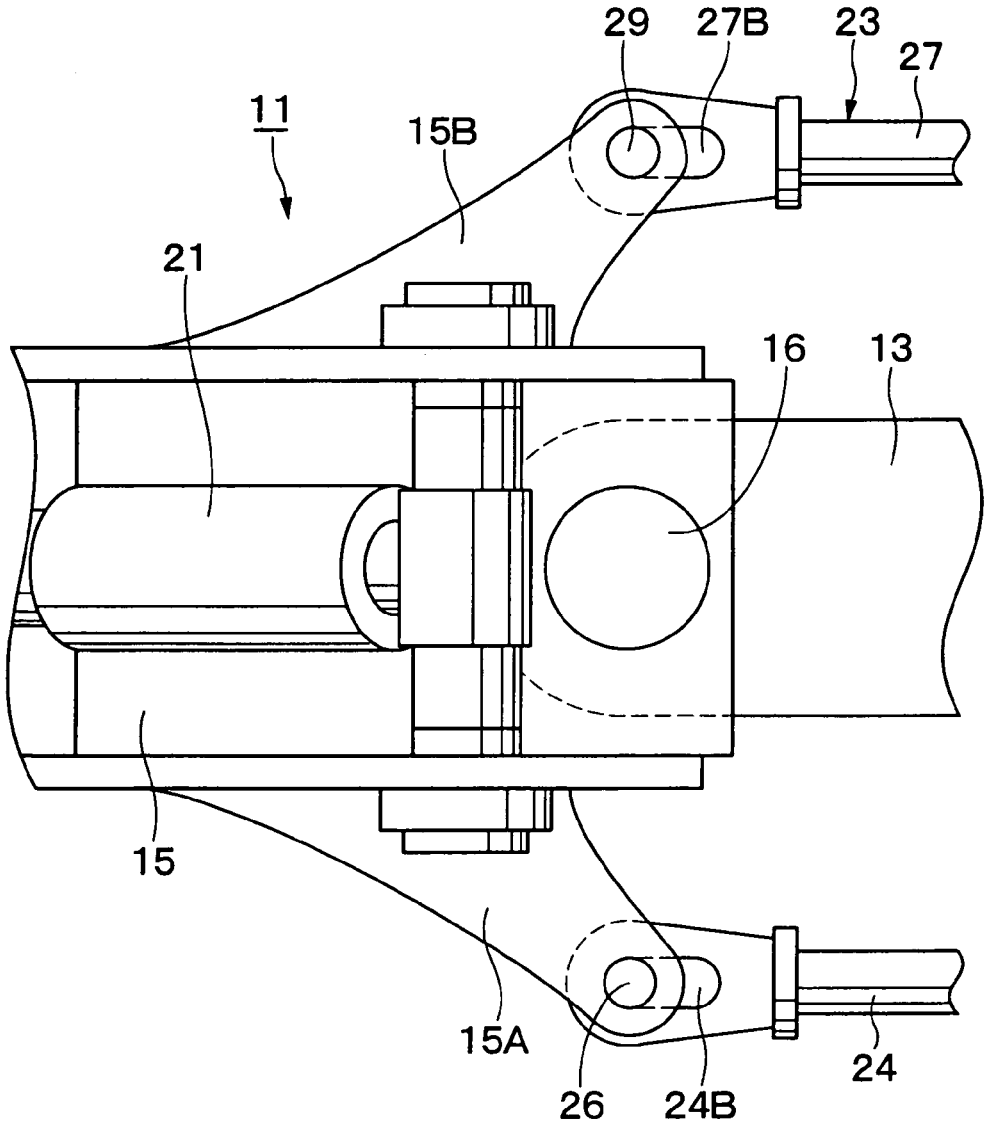
FIG. 6 is an enlarged view of the essential portion in FIG. 3, showing the distal ends of left and right links.

Further, as shown in FIG. 6, in the distal end of the left link 24, a long hole 24B is formed as a pin movable hole that is extended in the longitudinal direction of the link. Furthermore, a link joint pin 26 which is fitted between the left brackets 15A of the third boom 15 is inserted (or loosely fitted) into the long hole 24B at the position closest to the distal end of the link. The link joint pin 26 is rotatable in the long hole 24B, and is movable in the direction of the length of the long hole 24 (the longitudinal direction of the left link 24).

In this case, the length of the long hole 24B is so designated as to be greater (e.g., about two to three times the size of the link joint pin 26) than the outer diameter of the link joint pin 26, and the width of the long hole 24B is so designated as to be equal to the outer diameter of the link joint pin 26. Therefore, since the link joint pin 26 can travel within a specific direction along the length of the long hole 24B, instability of the joint pin 26 in the widthwise direction of the long hole 24B can be prevented.

Figure 7:
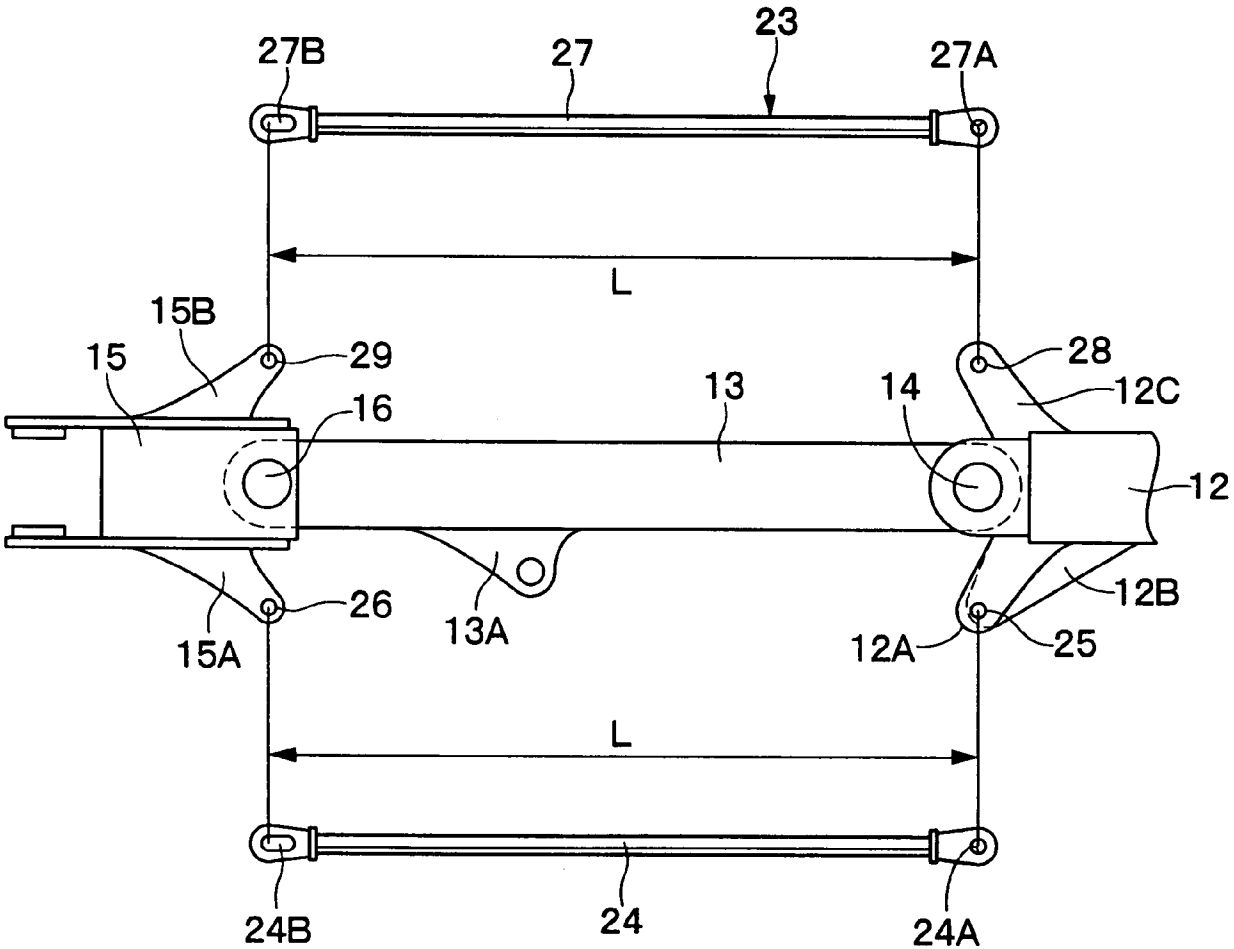
FIG. 7 is a plan view of the state before the first and third booms and the left and right links are assembled.

In addition, as shown in FIG. 7, a distance L between the distal end of the long hole 24B (the location wherein the link joint pin 26 is inserted) and the pin hole 24A is so designated as to be equal to a distance between the link joint pins 25 and 26. Therefore, the long hole 24B extends from the location wherein the link joint pin 26 is inserted toward the rod of the left link 24 (toward the pin hole 24A), so that the long hole 24B is fitted in the distance L.

As described above, the left link 24 is connected between the left brackets 12A and 15A by employing the link joint pins 25 and 26, and constitutes a left parallel link mechanism together with the left brackets 12A and 15A and the second boom 13.

At this time, when the offset cylinder 20 is extended and the second boom 13 is moved to the right side, as shown in FIG. 4, the left link 24 pulls the third boom 15 to the left side. Therefore, a force $F_L$ is exerted on the left link 24 in a direction in which the pertinent link is to be extended (hereinafter referred to as a pulling direction force $F_L$). Further, when an external force is exerted from the left side on members, such as the third boom 15, the arm 17 and the bucket 18, the pulling direction force $F_L$ is also exerted on the left link 24 in order to maintain each one of the members parallel to the first boom 12.

In these cases, since the link joint pin 26 is fitted into the distal end (the side of the third boom 15) of the long hole 24B of the left link 24, the left link 24 accepts the pulling direction force $F_L$ between the first boom 12 and the third boom 15 and can hold the third boom 15 parallel to the first boom 12.

At this time, when a force is exerted from the side of the third boom 15 on the right link 27 in a direction in which the pertinent link 27 is to be compressed (hereinafter referred to as a compression direction force), the link joint pin 29 can still be moved slightly in the long hole 27B of the right link 27 from the distal end to the middle portion, so that the right link 27 need not receive the compression direction force.

Figure 5:
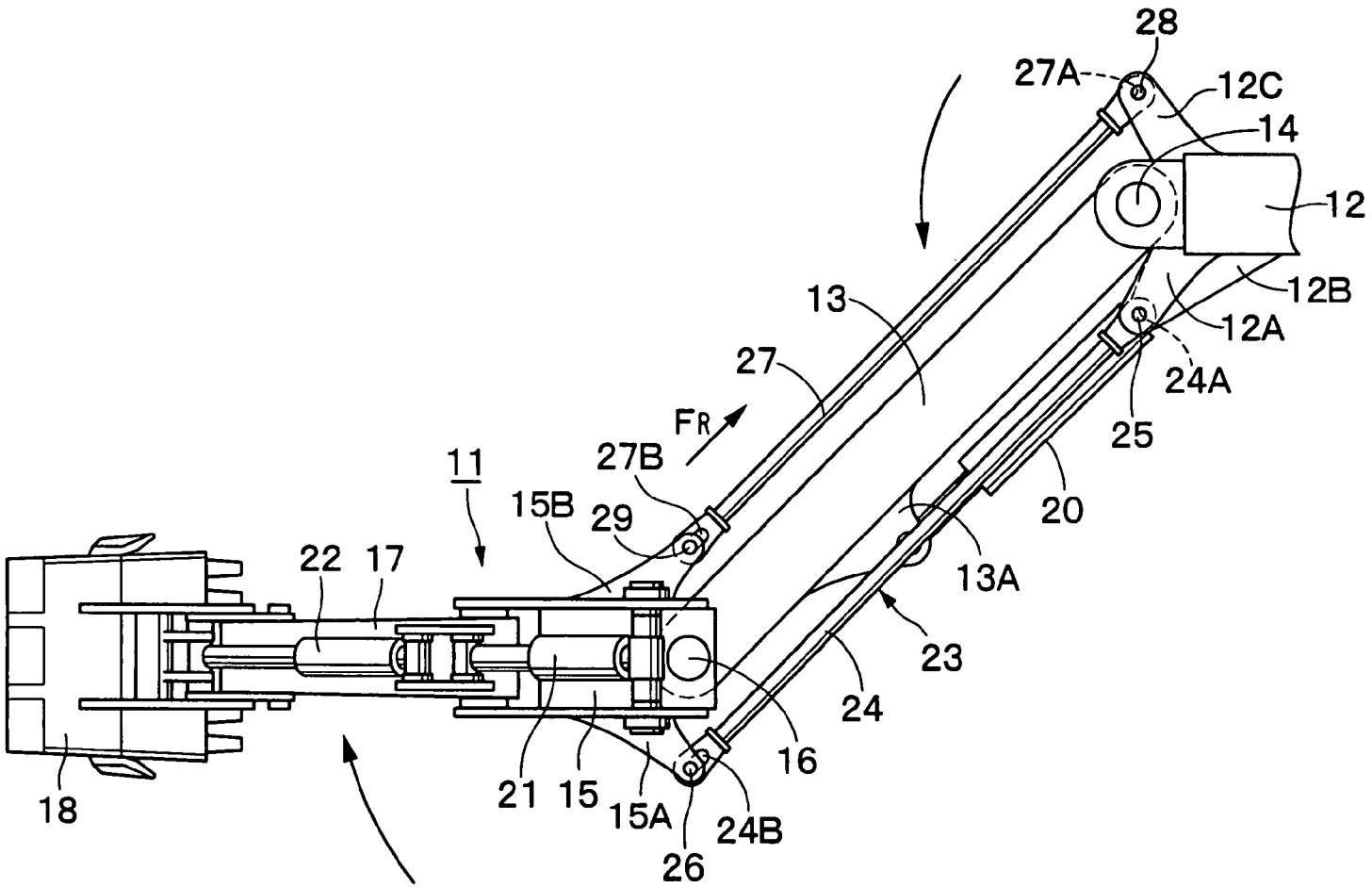
FIG. 5 is a plan view of the same in FIG. 3, showing the state wherein the third boom is offset to the left side.

Next, indicated at 27 is a right link provided on the right side of the second boom 13. When the second boom 13 is moved to the left side by the offset cylinder 20, as shown in FIG. 5, the right link 27 pulls and moves the third boom 15 to the right side. As a result, the third boom 15, the arm 17, and the bucket 18 are moved to the left side of the vehicle body (offset), while maintaining the posture parallel to the first boom 12.

In this case, the right link 27, substantially in the same manner as the left link 24, is a rod member which is a metal rod that is extended substantially parallel to the second boom 13, and a circular pin hole 27A is formed in the base end of the right link 27, while a long hole 27B is formed in the distal end of the right link 27 as a pin movable hole that is extended in the longitudinal direction of the right link 27. Further, a link joint pin 28 which is fixed between the right brackets 12C of the first boom 12 is rotatably inserted in the pin hole 27A.

Furthermore, a link joint pin 29 which is fixed between the right brackets 15B of the third boom 15 is inserted into the distal end of the long hole 27B so as to be rotatable and movable in the direction of the length of the long hole 27B (the direction of the diameter of the joint pin 29). In this manner, the right link 27 constitutes a right parallel link mechanism, together with the right brackets 12C and 15B and the second boom 13.

In addition, the left link 24 and the right link 27 are located at substantially symmetrical positions on the left and right sides along the second boom 13, and the right link 27 makes an opposite movement to the left link 24, relative to the swinging movement of the second boom 13 or upon the application of an external force from the side of the second boom 13.

That is, when the offset cylinder 20 is retracted and the second boom 13 is moved to the left side, as shown in FIG. 5, the right link 27 pulls the third boom 15 to the right side. Thus, a force $F_R$ is exerted on the right link 27 in a direction in which the pertinent link is to be extended (hereinafter referred to as a pulling direction force $F_R$). Further, when an external force is exerted from the right side on members, such as the third boom 15, the arm 17 and the bucket 18, the pulling direction force $F_R$ is also exerted on the right link 27 in order to hold each one of the members parallel to the first boom 12.

In these cases, since the link joint pin 29 is fitted into the distal end (the side of the third boom 15) of the long hole 27B of the right link 27, the right link 27 accepts the pulling direction force $F_R$ between the first boom 12 and the third boom 15 and can hold the third boom 15 parallel to the first boom 12.

At this time, when the force is exerted from the side of the third boom 15 on the left link 24 in the direction in which the pertinent link 24 is to be compressed, the link joint pin 26 can still be moved in the long hole 24B of the left link 24 slightly from the distal end to the middle portion, so that the left link 24 need not accept the compression direction force.

As described above, since the left and right links 24 and 27 need not receive the compression direction force, these links are formed with the minimum cross section area and strength required for accepting the pulling direction forces $F_L$ and $F_R$, and smaller rods are employed than that of the prior arts.

For the working mechanism 11 of the hydraulic excavator 1 according to the first embodiment having the above described arrangement, the operation will now be described.

To perform an excavation operation on the right side of the vehicle body, the offset cylinder 20 is extended and the second boom 13 is moved to the right (see FIG. 4). Thereafter, the left link 24 pulls the third boom 15 to swing the third boom 15 to the left side without any interference by the right link 27. Thus, the arm 17, the bucket 18, or the like can be moved parallel to the right side of the vehicle body, and in this position, an excavation operation, such as the digging of side ditches, can be performed.

Further, when the offset cylinder 20 is retracted, the second boom 13 is moved to the left (see FIG. 5). Then, the right link 27 pulls the third boom 15, so that the third boom 15 swings to the right side without any interference by the left link 24. Thus, the arm 17, the bucket 18, or the like can be moved parallel to the left side of the vehicle body, and in this position, an excavation operation, such as the digging of side ditches, can be performed.

During the excavation operation, when an external force is exerted from the side on the bucket 18, the arm 17, the third boom 15, or the like, this external force is received as the pulling direction force $F_L$ or $F_R$ by the left link 24 or the right link 27. Thus, without the compression direction force being applied to the other link, the arm 17 and the bucket 18 can be maintained parallel to the first boom 12.

Therefore, according to the arrangement for this embodiment, the parallel support member 23 which is composed of the links 24 and 27 that are respectively located to the left and right sides is provided with the second boom 13. Thus, when the second boom 13 is moved to the right side, the left link 24 pulls and swings the third boom 15 to the left side, and can receive the pulling direction force $F_L$ between the first boom 12 and the third boom 15. At this time, since the link joint pin 29 can be slightly loosened in the long hole 27B of the right link 27, the application of the compression direction force to the right link 27 can be prevented.

Further, when the second boom 13 is moved to the left side, the right link 27 pulls and moves the third boom 15 to the right side, and can receive the pulling direction force $F_R$. At this time, since the link joint pin 26 can be slightly loosened in the long hole 24B of the left link 24, application of the compression direction force to the left link 24 can be prevented.

Thus, when the arm 17, the bucket 18, or the like are to be moved to the left or right side of the vehicle body, these can be held parallel to the first boom 12, and an operation such as the digging of side ditches can be smoothly performed.

In this case, when the second boom is moved to the left or right side, the left link 24 and the right link 27 need not accept the compression direction force. Therefore, regarding the links 24 and 27, the outer diameter, the cross section area and the weight are only the minimum that is required to accept the pulling direction forces $F_L$ and $F_R$, and small links 24 and 27 can be employed. Further, the structures of the brackets 12A, 12C, 15A and 15B that support the links 24 and 27 can also be simplified.

Therefore, the size and the weight of the entire working mechanism 11 including the links 24 and 27, and the brackets 12A, 12C, 15A, and 15B, can be reduced to improve the operating efficiency of the hydraulic excavator 1 on which this working mechanism 11 is mounted. By employing metal rods for the left link 24 and the right link 27, small but strong links can be provided and durability can be increased.

In addition, since the outer diameter for the left link 24 and the right link 27 can be reduced, even in a compact working mechanism, a sufficient gap can be obtained between the second boom 13 and the links 24 and 27, and without these component interfering with each other, the third boom 15 can be moved within a wide range in the horizontal direction. Therefore, the traveling distances in the left and right directions by the arm 17, the bucket 18, or the like can be extended and the function of the working mechanism 11 can be improved.

Furthermore, the long hole 24B, into which the link joint pin 26 on the side of the third boom 15 is to be movably inserted, is formed in the distal end of the left link 24, while the long hole 27B, into which the link joint pin 29 is to be movably inserted, is formed in the distal end of the right link 27. Thus, when the pulling direction force $F_L$ is exerted on the left link 24, the link joint pin 26 can be fitted into the distal end of the long hole 24B.

Therefore, the pulling direction force $F_L$ can be appropriately accepted by the left link 24, and the third boom 15 can be smoothly moved. At this time, if the compression direction force is applied to the right link 27, the link joint pin 29 can slide within the long hole 27B, so that application of the compression direction force to the right link 27 can be prevented.

Similarly, when the pulling direction force $F_R$ is exerted on the right link 27, the link joint pin 29 is fitted into the long hole 27B. Thus, the pulling direction force $F_R$ can be appropriately accepted by the right link 27, and since the link joint pin 26 slides within the long hole 24B, the left link 24 need not receive the compression direction force. Therefore, the bending and damaging of the left link 24 and the right link 27 can be steadily prevented.

Figure 8:
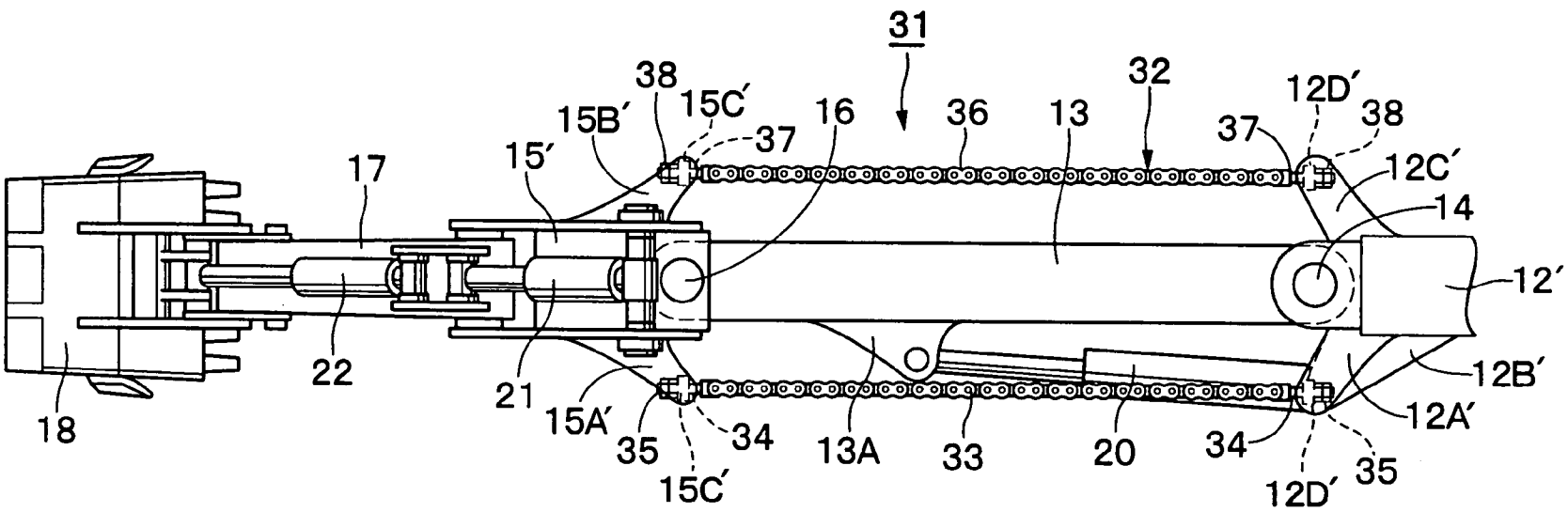
FIG. 8 is a plan view of the essential portion of a working mechanism for a hydraulic excavator according to a second embodiment of the present invention.
Figure 9:
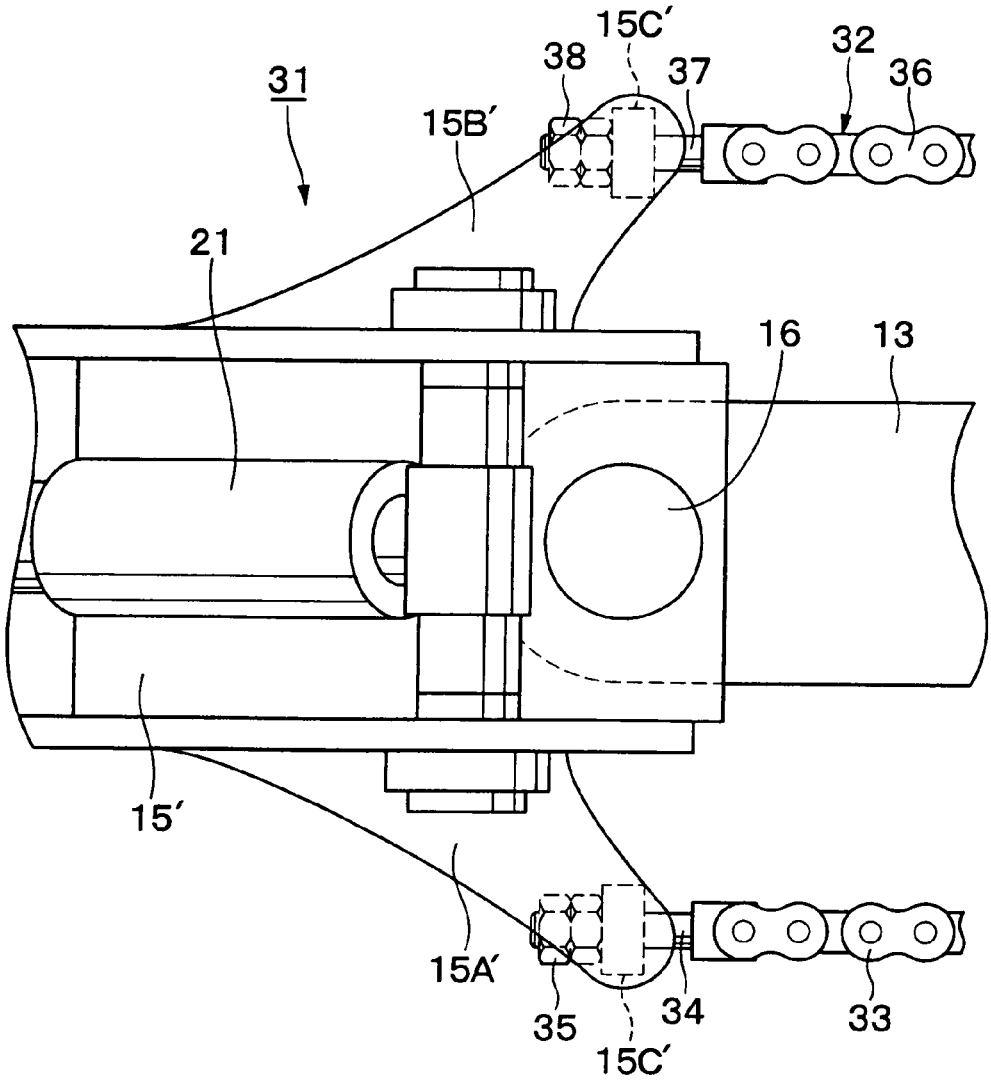
FIG. 9 is an enlarged view of the essential portion in FIG. 8, showing the distal ends of link chains.

A second embodiment of the present invention is shown in FIGS. 8 and 9. The feature of the second embodiment is that left and right links are constituted by employing chains. In the following description of the second embodiment, those component parts which are identical with counterparts in the foregoing first embodiment are simply designated by the same reference numerals to avoid repetitions of same explanations.

Reference numeral 31 denotes an offset boom type working mechanism. Substantially in the same manner as the first embodiment, the working mechanism 31 is constituted by a first boom 12', a second boom 13, a third boom 15', an arm 17, a bucket 18, cylinders 19, 20, 21 and 22, and a parallel support member 32 provided for the second boom 13.

However, the parallel support member 32 is formed by chains 33 and 36, which will be described after, that are respectively arranged on the left and right sides. Further, the first boom 12' has brackets 12A', 12B' and 12C', substantially in the same manner as the first embodiment, and a chain attachment 12D' is provided with the brackets 12A' and 12C'. A chain attachment 15C' is also provided with brackets 15A' and 15B' of the third boom 15'.

Indicated at 33 is a left chain provided on the left side of the second boom 13. As shown in FIGS. 8 and 9, the left chain 33 is, for example, a general-purpose metal chain that has the great strength against the pulling direction force, and is deflected (or bent) by the application of the compression direction force. Substantially in the same manner as the left link 24 in the first embodiment, the left chain 33 pulls and moves the third boom 15' to the left side when the second boom 13 is moved to the right side.

Further, end bolts 34 such as general-purpose bolts are provided on both ends of the left chain 33. The end bolt 34 at the base end is securely fixed by a double nut 35 to the attachment 12D' of the left bracket 12A' of the first boom 12'. The end bolt 34 at the distal end is also fixed by a double nut 35 to the attachment 15C' of the left bracket 15A' of the third boom 15'.

In this manner, the left chain 33 is connected between the left bracket 12A' of the first boom 12' and the left bracket 15A' of the third boom 15', and constitutes a parallel link mechanism together with the left brackets 12A' and 15A' and the second boom 13.

When the second boom 13 is swung to the right side, the left chain 33 receives the pulling direction force between the first boom 12' and the third boom 15', and pulls and moves the third boom 15' to the left side. Further, since the left chain 33 can be deflected upon the application of the compression direction force, the compression direction force can be released.

On the other hand, indicated at 36 is a right chain provided on the right side of the second boom 13. Substantially in the same manner as the left chain 33, the right chain 36 is formed by a metal chain wherein end bolts 37 are provided at both ends. The end bolt 37 at the base end is fixed by a double nut 38 to the attachment 12D' of the right bracket 12C' of the first boom 12'. Similarly, the end bolt 37 at the distal end is fixed by a double nut 38 to the attachment 15C' of the right bracket 15B' of the third boom 15'.

In this manner, the right chain 36 constitutes a right parallel link mechanism together with the right brackets 12C', 15B', and the second boom 13. When the second boom 13 is moved to the left side, the right chain 36 pulls and moves the third boom 15' to the right side, substantially in the same manner as the right link 27 in the first embodiment.

Being arranged in the same manner as described above, the second embodiment can obtain substantially the same operational effects as the foregoing first embodiment of the invention. Especially in the second embodiment, since the left and right links are formed by using the chains 33 and 36, the pulling direction force can be stably received while these chains 33 and 36 are extended without being deflected, or when the compression direction force is exerted, this force can be easily released by the deflection of the chains 33 and 36.

Thus, since chains 33 and 36 that are lighter than metal rods are employed, a reduction in the size and the weight of the working mechanism 31 can be promoted. Further, since general-purpose metal chain can be employed for the chains 33 and 36, costs can be reduced.

Figure 10:
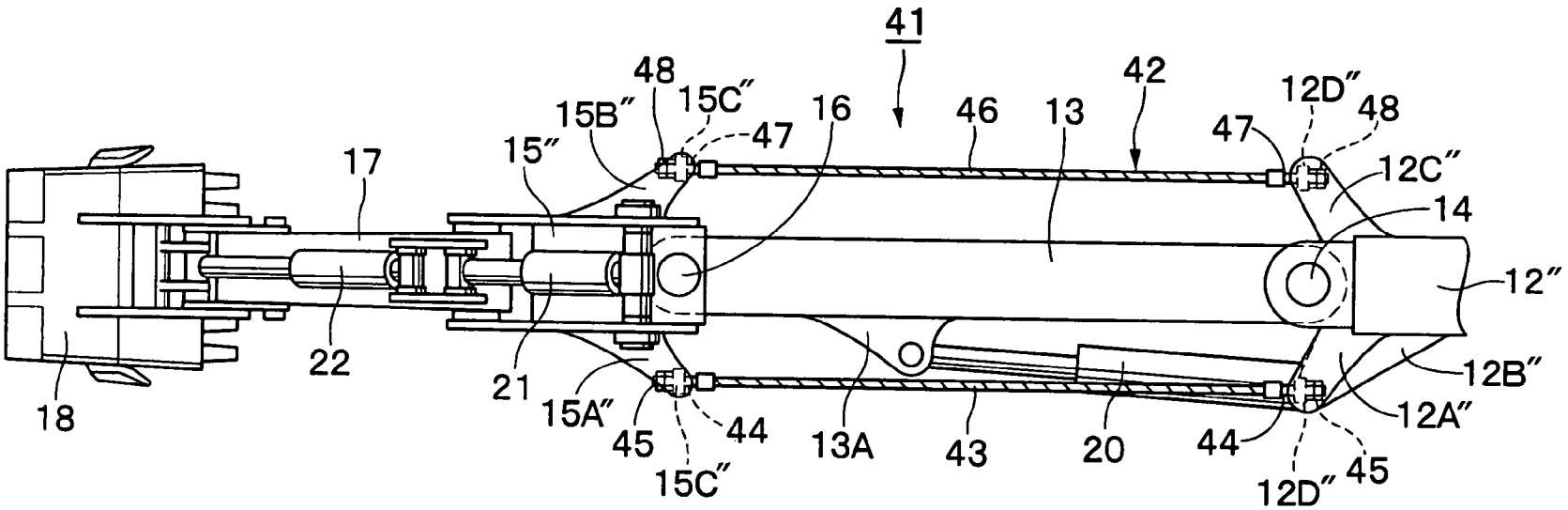
FIG. 10 is a plan view of the essential portion of a working mechanism for a hydraulic excavator according to a third embodiment of the present invention.

A third embodiment of the present invention is shown in FIG. 10. The feature of the third embodiment is that left and right links are formed by wire cables. In the following description of the third embodiment, those component parts which are identical with counterparts in the foregoing first embodiment are simply designated by the same reference numerals to avoid repetitions of same explanations.

Reference numeral 41 denotes an offset boom type working mechanism. Substantially in the same manner as the first embodiment, the working mechanism 41 is constituted by a first boom 12", a second boom 13, a third boom 15", an arm 17, a bucket 18, cylinders 19, 20, 21 and 22, and a parallel support member 42 provided for the second boom 13.

However, the parallel support member 42 is formed by wire cables 43 and 46, which will be described after, that are arranged respectively on the left and right sides. Further, the first boom 12" has the brackets 12A", 12B" and 12C", and wire cable attachments 12D" is provided with the brackets 12A" and 12C". Further, a chain attachment 15C" is also provided for brackets 15A" and 15B" of the third boom 15".

Denoted at 43 is a left wire cable provided on the left side of the second boom 13. The left wire cable 43 is a general-purpose metal wire cable that has a great strength against the pulling direction force and can release the compression direction force by being deflected. When the second boom 13 is moved to the right side, substantially in the same manner as the left link 24 in the first embodiment, the left wire cable 43 pulls and moves the third boom 15" to the left side.

Furthermore, substantially in the same manner as the left chain 33 in the second embodiment, end bolts 44 are provided on both ends of the left wire cable 43. The end bolt 44 at the base end is fixed by a double nut 45 to the attachment 12D" of the left bracket 12A" of the first boom 12". The end bolt 44 at the distal end is fixed to the attachment 15C" of the left bracket 15A" of the third boom 15".

Reference numeral 46 denotes a right wire cable provided on the right side of the second boom 13. The right wire cable 46, substantially in the same manner as the left wire cable 43, is formed by a general-purpose metal wire cable for which end bolts 47 are provided at both ends.

Substantially in the same manner as the right chain 36 in the second embodiment, these end bolts 47 are fixed by double nuts 48 to the attachment 12D" of the right bracket 12C" of the first boom 12" and to the attachment 15C" of the right bracket 15B" of the third boom 15". When the second boom 13 is moved to the left side, the right wire cable 46 pulls and moves the third boom 15" to the right side, substantially in the same manner as the right link 27 in the first embodiment.

Being arranged in the same manner as described above, the third embodiment can obtain substantially the same operational effects as the foregoing first and second embodiments of the invention. Especially in this embodiment, since the left and right links are provided as the wire cables 43 and 46, the reduction in the size and the weight of the working mechanism 41 and a reduction in the manufacturing costs thereof can be further promoted.

Figure 11:
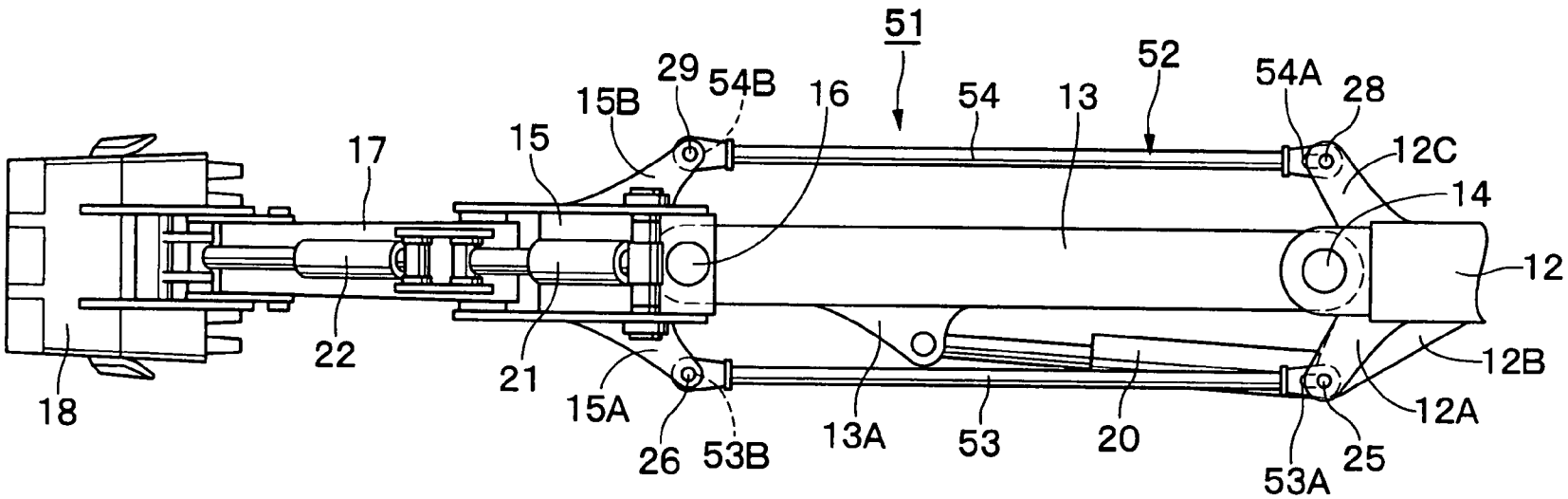
FIG. 11 is a plan view of the essential portion of a working mechanism for a hydraulic excavator according to a fourth embodiment of the present invention.
Figure 12:
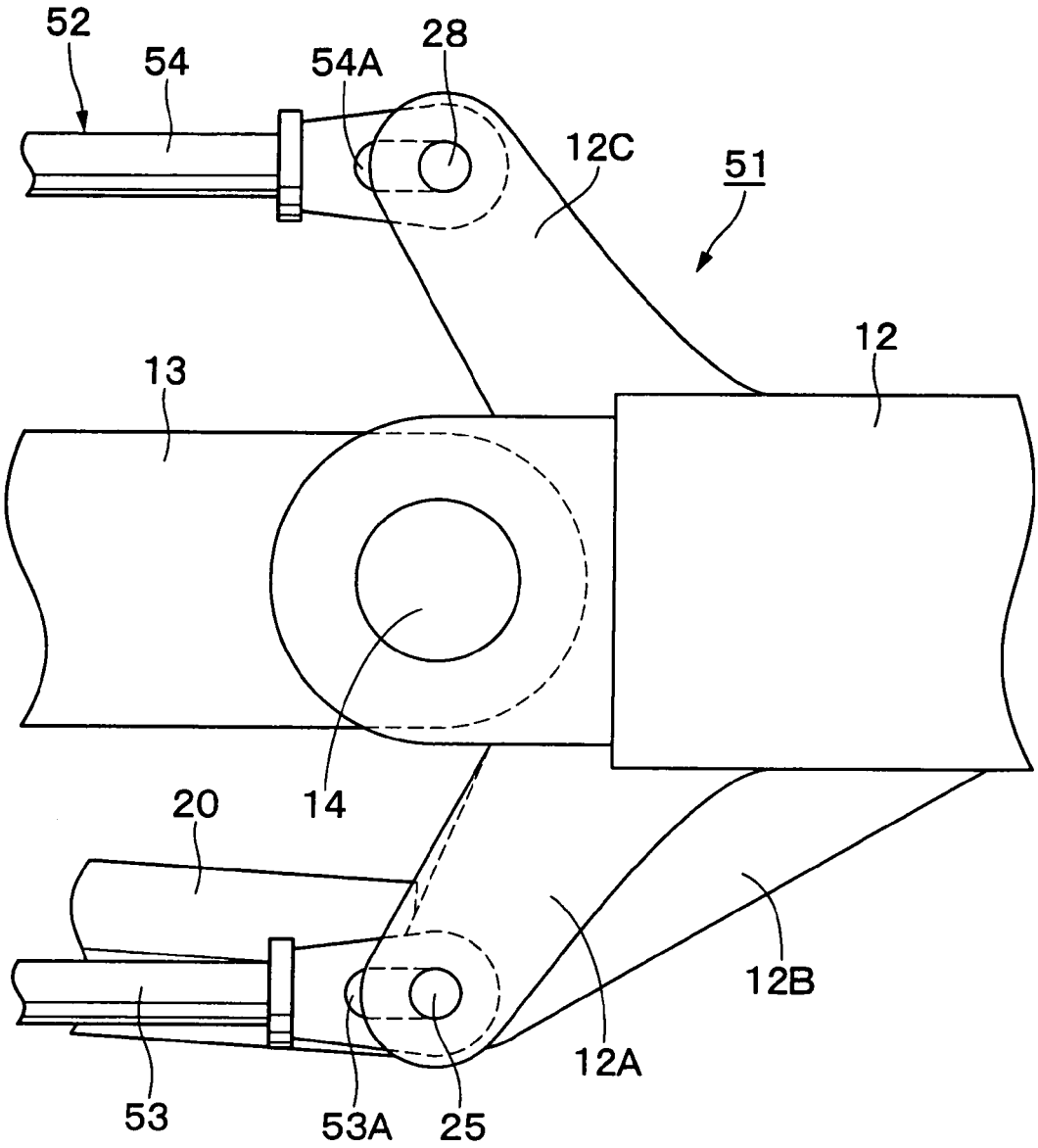
FIG. 12 is an enlarged view of the essential portion in FIG. 11, showing the base ends of left and right links.

A fourth embodiment of the present invention is shown in FIGS. 11 and 12. The feature of the fourth embodiment is that long holes are formed in the base ends of left and right links. In the following description of the fourth embodiment, those component parts which are identical with counterparts in the foregoing first embodiment are simply designated by the same reference numerals to avoid repetitions of same explanations.

Indicated at 51 is an offset boom type working mechanism constructed substantially in the same manner as the first embodiment. Reference numeral 52 denotes a parallel support member, which is a constituent of the working mechanism 51 and which is formed by links 53 and 54 respectively arranged on the left and right sides.

However, a long hole 53A that is longitudinally extended is formed in the base end of the left link 53, and a link joint pin 25 of a first boom 12 is inserted into the long hole 53A so as to be rotatable and movable in the direction of the length of the long hole 53A (the longitudinal direction of the left link 53).

Further, a circular pin hole 53B is formed in the distal end of the left link 53, and a link joint pin 26 for a third boom 15 is fitted into the pin hole 53B so as to be rotatable. As a result, due to the long hole 53A at the base end, the left link 53 does not receive the compression direction force that is exerted on the left link 53.

On the other hand, the right link 54 is formed substantially in the same manner as the left link 53. A long hole 54A is formed in the base end of the right link 54, so that a link joint pin 28 for the first boom 12 can be inserted into the long hole 54A so as to be rotatable and movable in the longitudinal direction. Further, a circular pin hole 54B is formed in the distal end of the right link 54, so that a link joint pin 29 for the third boom 15 can be rotatably fitted into the pin hole 54B.

Being arranged in the same manner as described above, the fourth embodiment can also obtain substantially the same operational effects as the foregoing first embodiment of the invention. In this embodiment, especially, the long holes 53A and 54A are formed in the base ends of the left link 53 and the right link 54. For this arrangement, the links 24 and 27 which are used in the first embodiment can be employed by reversing the front and rear side of the links.

Figure 13:
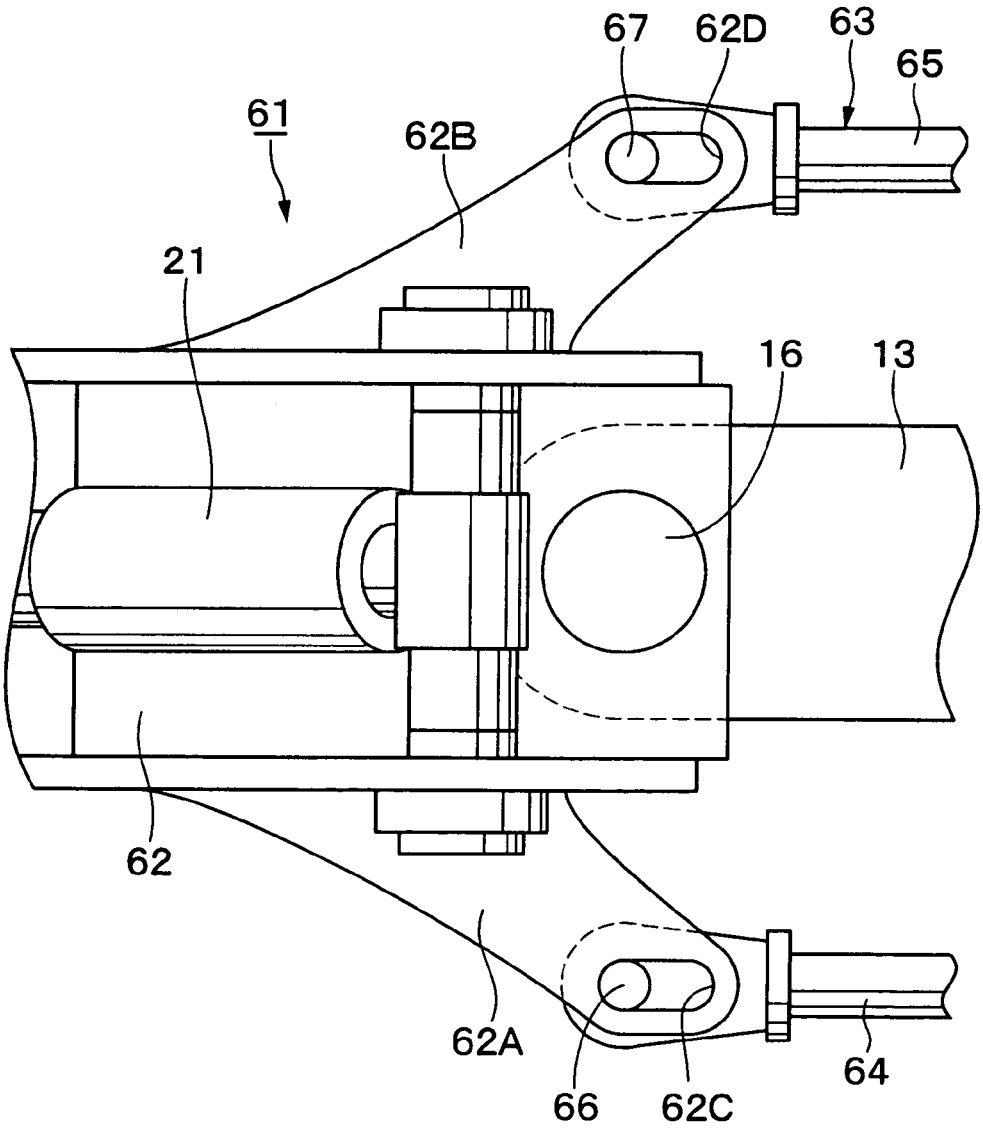
FIG. 13 is an enlarged view of the essential portion, showing the distal ends of the link of a working mechanism for a hydraulic excavator according to a fifth embodiment of the present invention.
Figure 14:
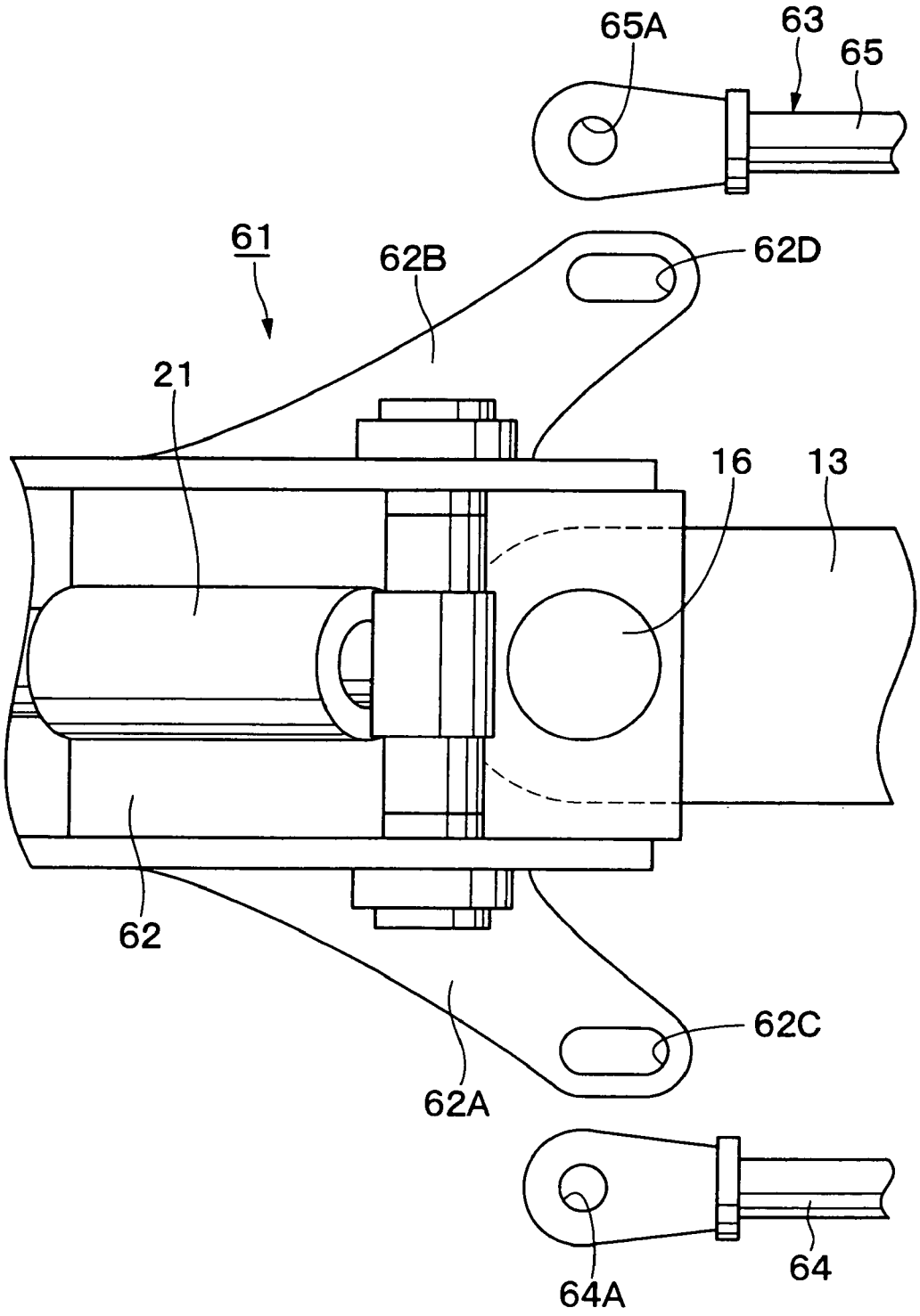
FIG. 14 is an enlarged view of the essential portion taken at the same position as in FIG. 13 showing the state before a third boom and links are assembled together.

A fifth embodiment of the present invention is shown in FIGS. 13 and 14. The feature of the fifth embodiment is that long holes are formed in the brackets of the third boom. In this embodiment, the same reference numerals as are used in the first embodiment are also employed to denote corresponding components, and no further explanation for them will be given.

Reference numeral 61 denotes an offset boom type working mechanism. Substantially in the same manner as the first embodiment, the working mechanism 61 includes a first boom, an arm and a bucket (none of them shown), a second boom 13, and a third boom 62 and a parallel support member 63, which will be described after.

Indicated at 62 is a third boom that is so provided at the distal end of the second boom 13 as to be swingable to the left and right side. Substantially in the same manner as the first embodiment, a left bracket 62A and a right bracket 62B are projected from the third boom 62. However, as shown in FIG. 14, in the left bracket 62A, a long hole 62C is formed as a pin movable hole having almost the same shape as the long hole 24B in the first embodiment. Another long hole 62D is also formed in the right bracket 62B, and these long holes 62C and 62D are extended substantially in the longitudinal direction of links 64 and 65.

Denoted at 63 is a parallel support member provided for the second boom 13. Substantially in the same manner as the first embodiment, the parallel support member 63 is formed by links 64 and 65 that are respectively arranged on the left and right sides of the second boom 13. In this case, link joint pins (not shown) are fixed to the base ends of the links 64 and 65, and are rotatably fitted into circular pin holes (not shown) that are formed in the left and right brackets of the first boom.

In addition, a circular pin hole 64A is formed in the distal end of the left link 64, and a link joint pin 66 is inserted into the pin hole 64A and the long hole 62C in the left bracket 62A of the third boom 62. In this case, the link joint pin 66 is rotatable within the long hole 62C, and is movable in the direction of the length of the long hole 62C (the longitudinal direction of the left link 64).

On the other hand, a circular pin hole 65A is formed in the distal end of the right link 65, and another link joint pin 67 is inserted into the pin hole 65A and the long hole 62D of the right bracket 62B. In this case, the link joint pin 67 is rotatably inserted into the long hole 62D, and is movable in the direction of the length.

Being arranged in the same manner as described above, the fifth embodiment can also obtain substantially the same operational effects as the foregoing first embodiment of the invention.

Figure 15:
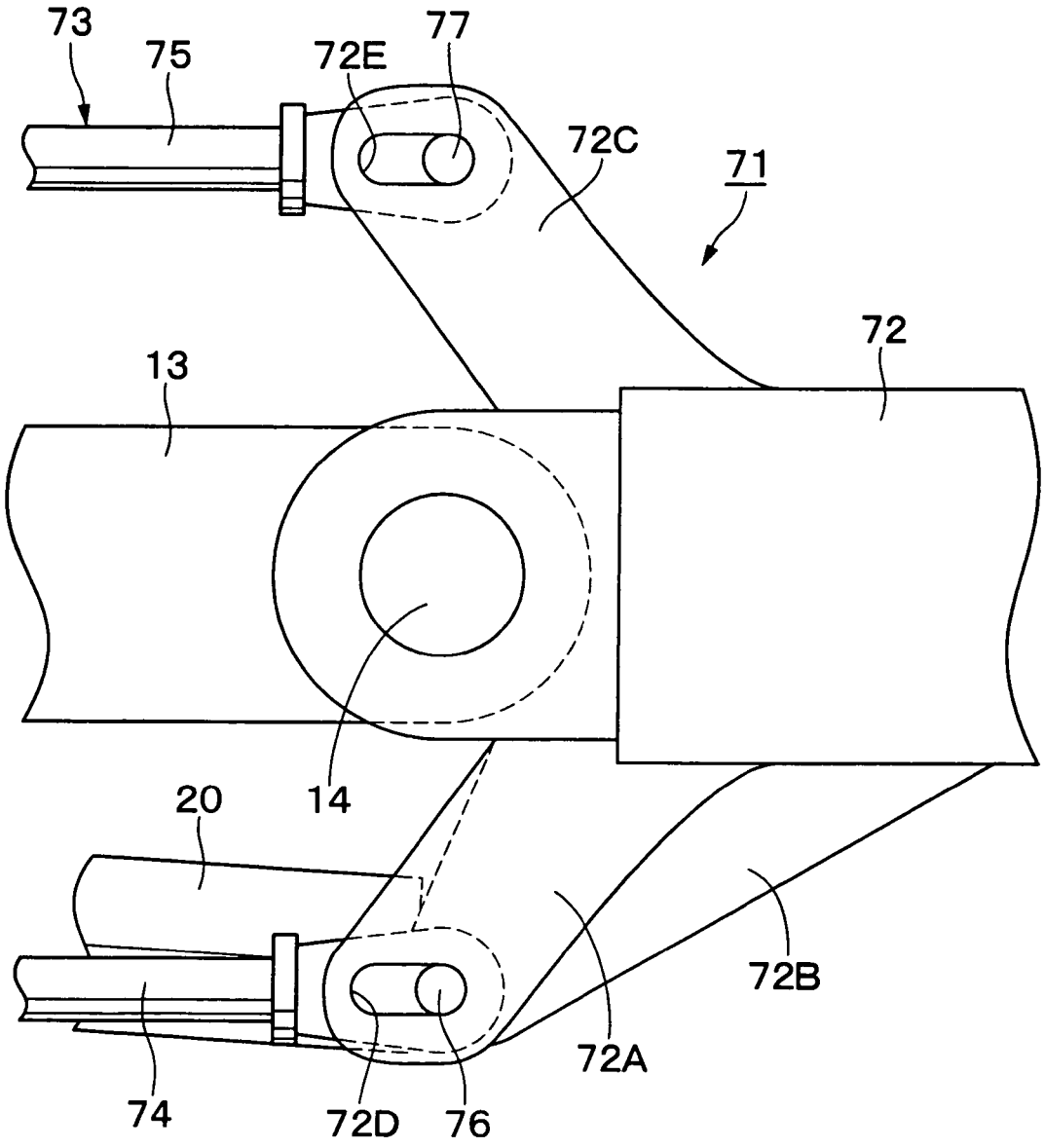
FIG. 15 is an enlarged view of the essential portion, showing the base end of the link of a working mechanism for a hydraulic excavator according to a sixth embodiment of the present invention.

A sixth embodiment of the present invention is shown in FIG. 15. The feature of the sixth embodiment is that long holes are formed in the brackets of the first boom. In this embodiment, the same reference numerals as are used in the first embodiment are employed to denote corresponding components, and no further explanation for them will be given.

Reference numeral 71 denotes an offset boom type working mechanism. Substantially in the same manner as the first embodiment, the working mechanism 71 is constituted by a first boom 72 and a parallel support member 73, both of which will be described after, a second boom 13, and a third boom, an arm and a bucket (none of them shown).

Indicated at 72 is a first boom that is a constituent of the base end of the working mechanism 71. Substantially in the same manner as the first embodiment, brackets 72A, 72B and 72C are projected from the first boom 72. However, in the left bracket 72A, a long hole 72D is formed as a pin movable hole having almost the same shape as the long hole 24B in the first embodiment. Another long hole 72E is formed in the right bracket 72C, and these long holes 72D and 72E are extended substantially in the longitudinal direction of links 74 and 75.

Reference numeral 73 denotes a parallel support member provided for the second boom 13. Substantially in the same manner as the first embodiment, the parallel support member 73 is formed by links 74 and 75 that are respectively arranged on the left and right sides of the second boom 13. In this case, link joint pins (not shown) are fitted into the distal ends of the links 74 and 75 substantially in the same manner as the fifth embodiment, and are rotatably inserted into, for example, circular pin holes that are formed in the left and right brackets of the third boom.

Furthermore, a link joint pin 76 is formed at the base end of the left link 74, and is inserted into the long hole 72D in the left bracket 72A of the first boom 72. In this case, the link joint pin 76 is rotatable within the long hole 72D, and is movable in the direction of the length of the long hole 72D (the longitudinal direction of the left link 74).

On the other hand, another link joint pin 77 is formed at the base end of the right link 75, and is so inserted as to be rotatable within the long hole 72D of the right bracket 72B, and is movable in the direction of the length.

Being arranged in the same manner as described above, this embodiment can also obtain substantially the same operational effects as the foregoing first, fourth, and fifth embodiments of the invention.

Figure 16:
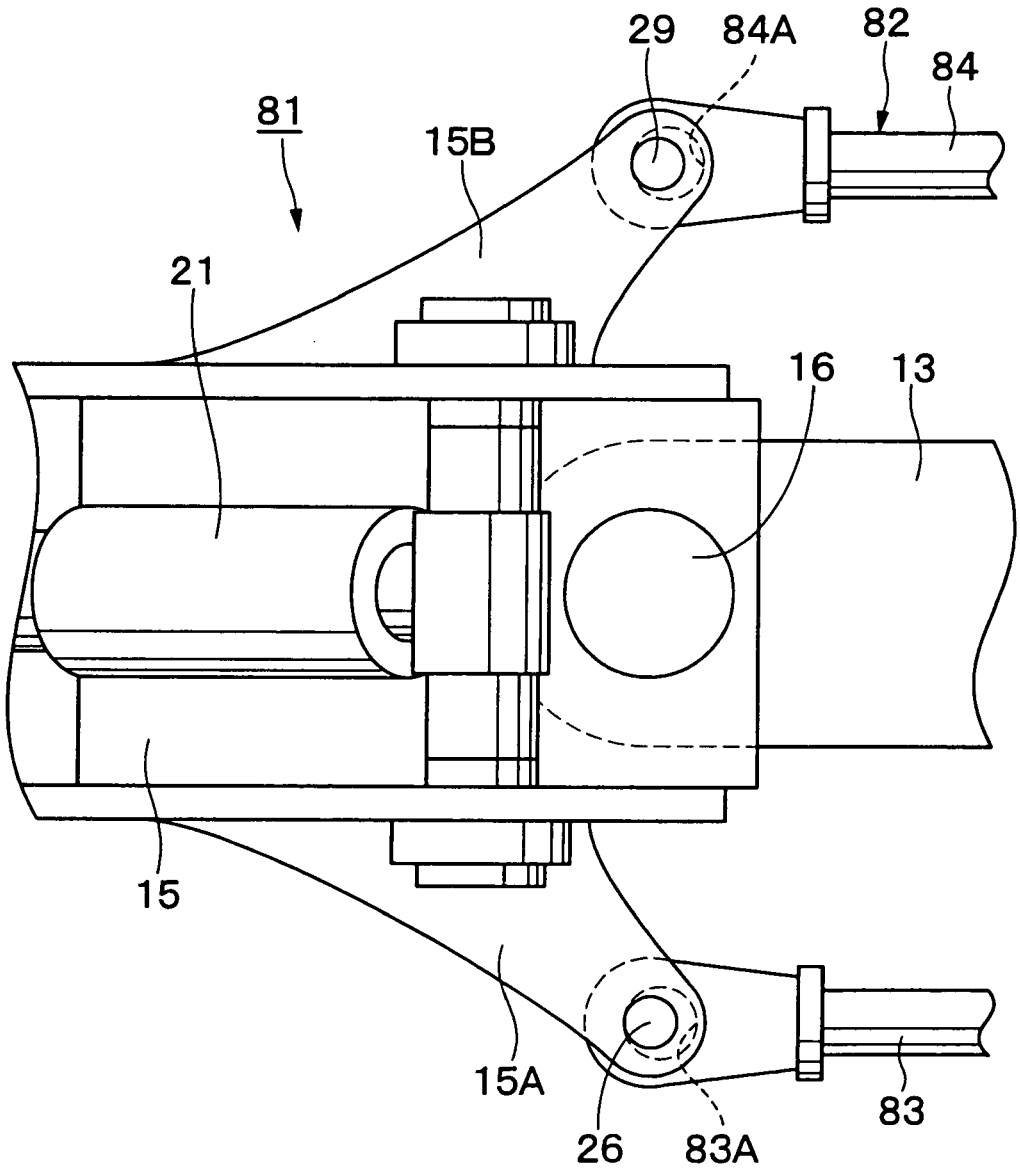
FIG. 16 is an enlarged view of the essential portion, showing the distal end of the link of a working mechanism for a hydraulic excavator according to a seventh embodiment of the present invention.

A seventh embodiment of the present invention is shown in FIG. 16. The feature of the seventh embodiment is that holes having a large diameter are employed as pin movable holes. In this embodiment, the same reference numerals as are used in the first embodiment are also employed to denote corresponding components, and no further explanation for them will be given.

Reference numeral 81 denotes an offset boom type working mechanism. Substantially in the same manner as the first embodiment, the working mechanism 81 is constituted by a first boom, an arm and a bucket (none of them shown), a second boom 13, a third boom 15 and a parallel support member 82 that will be described after.

Indicated at 82 is a parallel support member provided for the second boom 13. Substantially in the same manner as the first embodiment, the parallel support member 82 is formed by links 83 and 84 that are respectively arranged on the left and right sides of the second boom 12. The base ends of the links 83 and 84 are rotatably connected to the left and right brackets (none of them shown) of the first boom by employing joint pins.

Further, in the distal end of the left link 83, a large-diameter hole 83A is formed as a pin movable hole having a circular shape. The diameter of the large-diameter hole 83A is so formed as to be greater than the outer diameter of a link joint pin 26. And at the portion of the large-diameter hole 83A nearest the distal end of the left link 83, the link joint pin 26 which is formed on the side of the third boom 15 is inserted (or is loosely fitted in). Thus, the link joint pin 26 is rotatable within the large-diameter hole 83A, and is movable toward the base end of the left link 83 and in the longitudinal direction of the pertinent link.

On the other hand, for example, a large-diameter hole 84A having a circular shape is also formed in the distal end of the right link 84. The diameter of the large-diameter hole 84A is so formed as to be greater than the outer diameter of a link joint pin 29. In the large-diameter hole 84A, the link joint pin 29 which is formed on the side of third boom 15 is so inserted as to be rotatable and movable in the longitudinal direction of the right link 84.

Being arranged in the same manner as described above, the seventh embodiment can obtain substantially the same operational effects as the foregoing first embodiment of the invention. Especially in this embodiment, since the large-diameter holes 83A and 84A having a circular shape are formed as pin movable holes, a formation of these holes can be easily performed, and productivity can be improved.

Figure 17:
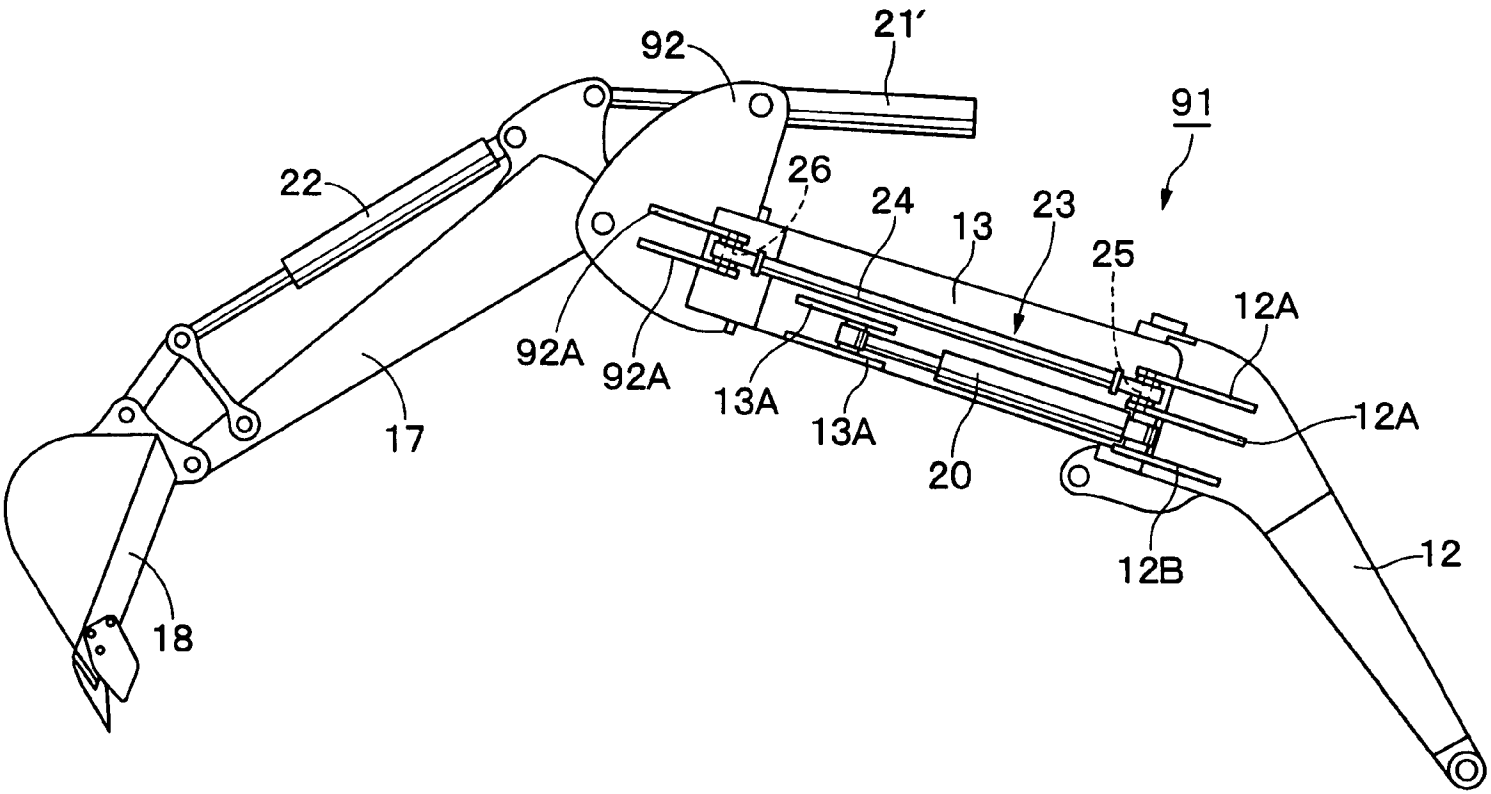
FIG. 17 is a front view of a working mechanism for a hydraulic excavator according to an eighth embodiment of the present invention.
Figure 18:
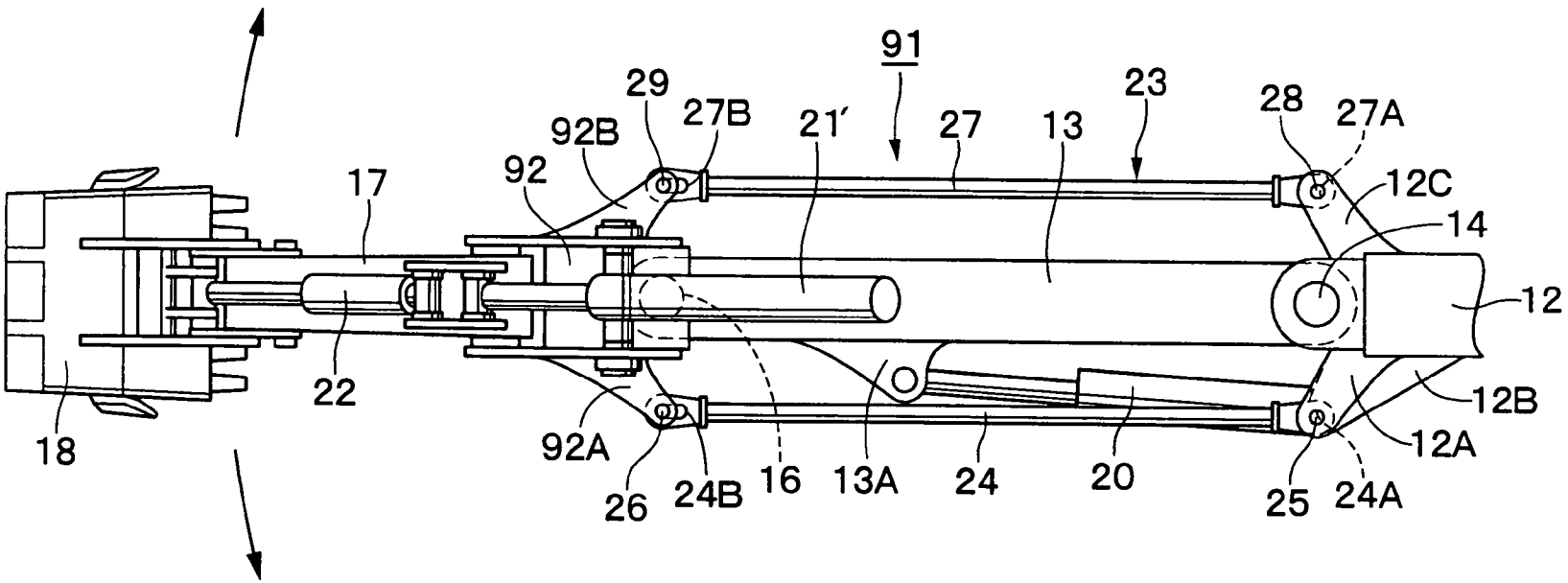
FIG. 18 is an enlarged plan view of the essential portion of the working mechanism in FIG. 17, viewed from the top.

An eighth embodiment of the present invention is shown in FIGS. 17 and 18. The feature of the eighth embodiment is that the present invention is applied for a working mechanism having a third boom that is shorter than the one in the first embodiment. In this embodiment, the same reference numerals as are used in the first embodiment are employed to denote corresponding components, and no further explanation for them will be given.

Designated at 91 is a working mechanism mounted on an offset boom type hydraulic excavator. As shown in FIGS. 17 and 18, the working mechanism 91 is constituted by a first boom 12, a second boom 13, an arm 17, a bucket 18, cylinders 19, 20, 21' and 22, and a parallel support member 23, all of which are substantially the same as those in the first embodiment, and an arm support member 92 that will be described after.

Indicated at 92 is an arm support member that constitutes the third boom of the working mechanism 91. By welding a plural number of steel plates, the arm support member 92 is provided as a hollow structure that is shorter than the third boom 15 in the first embodiment. And the arm support member 92 is so connected with the distal end of the second boom 13 as to be swingable to the left and right side, and the arm 17 is so connected to the distal end of the arm support member 92 as to be rotatable to the upper and lower sides.

Further, substantially in the same manner as the third boom 15, upper and lower left brackets 92A are projected from the left side face of the arm support member 92, and are connected to a long hole 24B of a left link 24 by employing a link joint pin 26.

On the other hand, as shown in FIG. 18, upper and lower right brackets 92B (only one of them shown) are projected from the right side face of the arm support member 92, and are connected to a long hole 27B of the right link 27 by employing a link joint pin 29. Further, the arm cylinder 21' is provided between the arm support member 92 and the arm 17.

Being arranged in the same manner as described above, the eighth embodiment can obtain substantially the same operational effects as the foregoing first embodiment of the invention. Especially in accordance with the embodiment, since the present invention can also be applied for the working mechanism 91 having the short arm support member 92, the application range for the present invention can be extended.

According to the arrangement of the first embodiment, the long holes 24B and 27B have been formed in the left and right links 24 and 27. However, the present invention is not limited to the particular example shown. For example, the left and right links may be constituted by extensible rods that the maximum lengths are restricted.

Further, according to the second embodiment, links have been formed by employing the chains 33 and 36, and according to the third embodiment, links have been formed by employing the wire cables 43 and 46. However, the present invention is not limited to the particular example shown. For example, these links can be employed by another type links, that is, one part of the link may be formed by a metal rod, and the other part may be formed by a material such as a chain or a wire cable.

Furthermore, according to the arrangement of the seventh embodiment shown in FIG. 16, the large-diameter holes 83A and 84A have been formed in the distal ends of the links 83 and 84. However, the present invention is not limited to the particular example shown. For example, in the arrangement of the fourth embodiment in FIGS. 11 and 12, large-diameter holes may be formed in the base ends of the links 53 and 57. In this case, instead of the long holes 53A and 54A, large-diameter circular holes must be formed in the base ends of the links 53 and 54 that are employed for the fourth embodiment. And in these large-diameter holes, the link joint pins 25 and 28 fixed to the side of the first boom 12 must be inserted so as to be rotatable and movable in the longitudinal direction of the links.

In addition, according to this invention, for the arrangement of the fifth embodiment shown in FIGS. 13 and 14, for example, large-diameter holes may be formed in the brackets of the third boom. In this case, instead of the long holes 62C and 62D, large-diameter circular holes must be formed in the brackets 62A and 62B of the third boom 62 that is used for the fifth embodiment. And in these large-diameter holes, the link joint pins 66 and 67 which are formed at the distal ends of the links 64 and 65 must be inserted so as to be rotatable and movable in the longitudinal direction of the links.

Moreover, according to the invention, for the sixth embodiment shown in FIG. 15, for example, large-diameter holes may be formed in the brackets of the first boom. In this case, instead of the long holes 72D and 72E, large-diameter circular holes must be formed in the brackets 72A and 72C of the first boom 72 that is used for the sixth embodiment. And in these large-diameter holes, the link joint pins 76 and 77 which are fixed to the base ends of the links 74 and 75 must be inserted so as to be rotatable and movable in the longitudinal direction of the links.

Further, according to the eighth embodiment shown in FIG. 18, the left and right links 24 and 27 have been employed for the working mechanism 91 having the arm support member 92. However, the present invention is not limited to these links, and the chains 33 and 36, the wire cables 43 and 46 or the links 53 and 54 used in the second to the fourth embodiments may be employed for the working mechanism 91.

Furthermore, the case wherein the present invention is applied for the offset boom type hydraulic excavator 1 has been explained with examples of these embodiments. However, needless to say, the present invention can be similarly applied to other construction machines that are provided with booms.

The invention claimed is:

1. A working mechanism for a construction machine having a first boom mounted on a vehicle body of a construction machine as to be rotatable to upper and lower sides; a second boom mounted on a distal end of said first boom as to be swingable to left and right sides; a third boom mounted on a distal end of said second boom to be swingable to the left and right sides; an arm mounted on said third boom to be rotatable to the upper and lower sides and having a working tool mounted on the distal end thereof; and an offset cylinder which is arranged between said first boom and said second boom to swing said second boom to the left and right sides at the distal end of said first boom, characterized in that said working mechanism for a construction machine comprises:

a parallel support member formed by a pair of links, which are connected between said first boom and said third boom and which are respectively arranged at left and right positions, provided on on opposite sides of said second boom, and said third boom is supported by said parallel support member so as to be parallel to said first boom when said offset cylinder is extended or retracted;

each of said links that constitute said parallel support member has a base end rotatably connected to said first boom by use of a first joint pin and a distal end rotatably connected to said third boom by use of a second joint pin;

a first pin hole into which said first hole joint pin is inserted is formed in said base end of said link, and a second pin hole into which said second joint pin is inserted is formed in said distal end of said link, and wherein one of said first and second pin holes is formed as an oversized hole that said first or second joint pin is inserted into whereby said first or second pin is movable in the longitudinal direction of said link.

2. A working mechanism for a construction machine having a first boom mounted on a vehicle body of a construction machine as to be rotatable to upper and lower sides; a second boom mounted on a distal end of said first boom as to be swingable to left and right sides; a third boom mounted on a distal end of said second boom to be swingable to left and right sides; an arm mounted on said third boom to be rotatable to the upper and lower sides and having a working tool mounted on the distal end thereof; and an offset cylinder which is arranged between said first boom and said second boom to swing said second boom to the left and right sides at the distal end of said first boom; characterized in that said working mechanism for a construction machine comprises:

a parallel support member formed by a pair of links, which are connected between said first boom and said third boom and which are respectively arranged at left and right positions, provided on on opposite sides of said second boom, and said third boom is supported by said parallel support member so as to be parallel to said first boom when said offset cylinder is extended or retracted;

each of said links that constitute said parallel support member has a base end rotatably connected to said first boom by use of a first joint pin and a distal end rotatably connected to said third boom by use of a second joint pin;

a first pin hole into which said first joint pin is inserted is formed in said first boom, and a second pin hole into which said second joint pin is inserted is formed in said third boom; and one of said first and second pin holes is formed as an oversized hole that said first or second joint pin is inserted into whereby said first or second pin is movable in a longitudinal direction of said link.

3. A working mechanism for a construction machine as defined in claim 1, wherein said oversized hole is formed as an elongated hole extended in a longitudinal direction of said link.

4. A working machine for a construction machine as defined in claim 1, wherein said oversized hole is formed as a large-diameter hole having a diameter larger than an outer diameter of said first or second joint pin.

5. A working mechanism for a construction machine as defined in claim 1, wherein said links that constitute said parallel support member are formed by rod members.

6. A working mechanism for a construction machine having a first boom mounted on a vehicle body of a construction machine as to be rotatable to upper and lower sides; a second boom mounted on a distal end of said first boom as to be swingable to left and right sides; a third boom mounted on a distal end of said second boom as to be swingable to the left and right sides; an arm mounted on said third boom to be rotatable to the upper and lower sides and having a working tool mounted on the distal end thereof; and an offset cylinder which is arranged between said first boom and said second boom to swing said second boom to the left and right sides at the distal end of said first boom, characterized in that said working mechanism for a construction machine comprises:

a parallel support member formed by a pair of links, which are connected between said first boom and said third boom and which are respectively arranged at left and right positions, provided on on opposite sides of said second boom, and said third boom is supported by said parallel support member so as to be parallel to said first boom when said offset cylinder is extended or retracted; and said links that constitute said parallel support members are either chains or wire cables, located between said first boom and said third boom, that receive a force in a pulling direction and that are flexible for accepting a force in a compression direction.

7. A working mechanism for a construction machine as defined in claim 2, wherein said oversized hole is formed as an elongated hole extended in a longitudinal direction of said link.

8. A working machine for a construction machine as defined in claim 2, wherein oversized hole is formed as a large-diameter hole having a diameter larger than an outer diameter of said first or second joint pin.

9. A working mechanism for a construction machine as defined in claim 2, wherein said links that constitute said parallel support member are formed by rod members.

* * * * *